US008375604B2

(12) United States Patent
Eder et al.

(10) Patent No.: US 8,375,604 B2
(45) Date of Patent: Feb. 19, 2013

(54) ARTICLE OF FOOTWEAR WITH MULTIPLE CLEAT SYSTEMS

(75) Inventors: Collin K. Eder, Portland, OR (US); Windra Fahmi, Beaverton, OR (US); Sebastien Mermet, Creteil (FR); Morgan Stauffer, Portland, OR (US)

(73) Assignee: Nike, Inc., Beaverton, OR (US)

( * ) Notice: Subject to any disclaimer, the term of this patent is extended or adjusted under 35 U.S.C. 154(b) by 456 days.

(21) Appl. No.: 12/755,677

(22) Filed: Apr. 7, 2010

(65) Prior Publication Data

US 2011/0247243 A1 Oct. 13, 2011

(51) Int. Cl.
*A43B 5/00* (2006.01)

(52) U.S. Cl. ..... 36/134; 36/59 C; 36/59 R; 36/114

(58) Field of Classification Search ..... 36/114, 36/134, 59 R, 59 C, 126–129
See application file for complete search history.

(56) References Cited

U.S. PATENT DOCUMENTS

| | | | | | |
|---|---|---|---|---|---|
| 3,619,916 | A | * | 11/1971 | Neri | 36/59 R |
| 3,988,840 | A | | 11/1976 | Minihane | |
| 4,098,011 | A | | 7/1978 | Bowerman et al. | |
| 4,327,503 | A | * | 5/1982 | Johnson | 36/32 R |
| 4,402,145 | A | * | 9/1983 | Dassler | 36/32 R |
| 4,546,559 | A | * | 10/1985 | Dassler | 36/129 |
| 4,559,724 | A | | 12/1985 | Norton | |
| 4,562,651 | A | * | 1/1986 | Frederick et al. | 36/102 |
| 4,667,425 | A | * | 5/1987 | Effler et al. | 36/126 |
| 4,741,114 | A | * | 5/1988 | Stubblefield | 36/32 R |
| 4,782,604 | A | * | 11/1988 | Wen-Shown | 36/127 |
| 4,787,156 | A | * | 11/1988 | Bade | 36/128 |
| 5,201,126 | A | * | 4/1993 | Tanel | 36/134 |
| 5,293,701 | A | | 3/1994 | Sullivan | |
| 5,752,332 | A | * | 5/1998 | Kataoka et al. | 36/134 |
| 5,896,680 | A | | 4/1999 | Kim et al. | |
| 5,943,794 | A | * | 8/1999 | Gelsomini | 36/127 |
| 5,979,083 | A | * | 11/1999 | Robinson et al. | 36/127 |
| 6,705,027 | B1 | * | 3/2004 | Campbell | 36/127 |
| 6,793,996 | B1 | | 9/2004 | Umezawa | |
| 6,817,117 | B1 | | 11/2004 | Campbell | |
| 6,948,264 | B1 | | 9/2005 | Lyden | |
| 7,650,707 | B2 | * | 1/2010 | Campbell et al. | 36/127 |
| 7,895,773 | B2 | * | 3/2011 | Robinson et al. | 36/127 |
| 2006/0130361 | A1 | * | 6/2006 | Robinson et al. | 36/25 R |
| 2009/0113765 | A1 | * | 5/2009 | Robinson et al. | 36/127 |

FOREIGN PATENT DOCUMENTS

| | | |
|---|---|---|
| EP | 0022716 | 1/1981 |
| GB | 2223394 | 4/1990 |

* cited by examiner

*Primary Examiner* — Marie Patterson
(74) *Attorney, Agent, or Firm* — Plumsea Law Group, LLC

(57) ABSTRACT

An article of footwear including a sole structure with multiple cleat systems is disclosed. A first cleat system has a first cleat design and one or more cleat member sets that are tuned to provide different levels of traction and flexibility to different regions of the sole structure. A second cleat system has a second cleat design and is disposed on the sole structure in a location to provide maximum traction for various playing surfaces. The sizes, material properties and arrangement of each cleat system are varied.

20 Claims, 15 Drawing Sheets

ARTICLE OF FOOTWEAR WITH MULTIPLE CLEAT SYSTEMS

BACKGROUND

The present invention relates generally to an article of footwear, and in particular to an article of footwear with multiple cleat systems.

Articles of footwear with cleat members of different sizes have been previously proposed. Sumitomo (U.S. Pat. No. 6,793,996) teaches a cleat structure that includes a variety of projections on a shoe sole. Sumitomo teaches a pin that is the tallest cleat. Sumitomo teaches that the hardness of the pin is greater than an adjacent cleat element. Additionally, British patent application publication number 2,223,394 teaches a shoe sole including a variety of cleats formed integrally with the sole that penetrate only a small distance into the ground with removable, larger cleats that can penetrate more deeply. The integral cleats can be cylindrical in shape and have a rounded top surface.

There exists a need in the art for articles of footwear that can achieve maximum traction on various types of ground surfaces and/or under various playing conditions.

SUMMARY

In one aspect, the invention provides an article of footwear, comprising: a sole structure, the sole structure including a first cleat system comprised of a first material and a second cleat system comprised of a second material; the first cleat system having a first cleat design; the second cleat system having a second cleat design; the first cleat system being associated with a forefoot region, a midfoot region, and a heel region of the sole structure; the second cleat system being associated with a first portion of the forefoot region and a second portion of the heel region; and wherein the second material is substantially more rigid than the first material.

In another aspect, the invention provides an article of footwear, comprising: a sole structure, the sole structure including a first cleat member set and a second cleat member set; the first cleat member set having a plurality of first cleat members with a length substantially oriented along the longitudinal axis of the article of footwear; the second cleat member set having a plurality of second cleat members with a length substantially oriented along the lateral axis of the article of footwear; wherein the first cleat member set is generally associated with a forefoot region and/or a heel region of the sole structure; and wherein the second cleat member set is generally associated with a midfoot region of the sole structure.

In another aspect, the invention provides an article of footwear, comprising: a sole structure, the sole structure including a first cleat member set and a second cleat member set; wherein the first cleat member set is generally associated with a forefoot region and/or a heel region of the sole structure; wherein the second cleat member set is generally associated with a midfoot region of the sole structure; the first cleat member set having a plurality of first cleat members with a length substantially oriented along the longitudinal axis of the article of footwear that extend a first height above the sole structure; the second cleat member set having a plurality of second cleat members with a length substantially oriented along the lateral axis of the article of footwear that extend a second height above the sole structure; and wherein the first height is greater than the second height.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
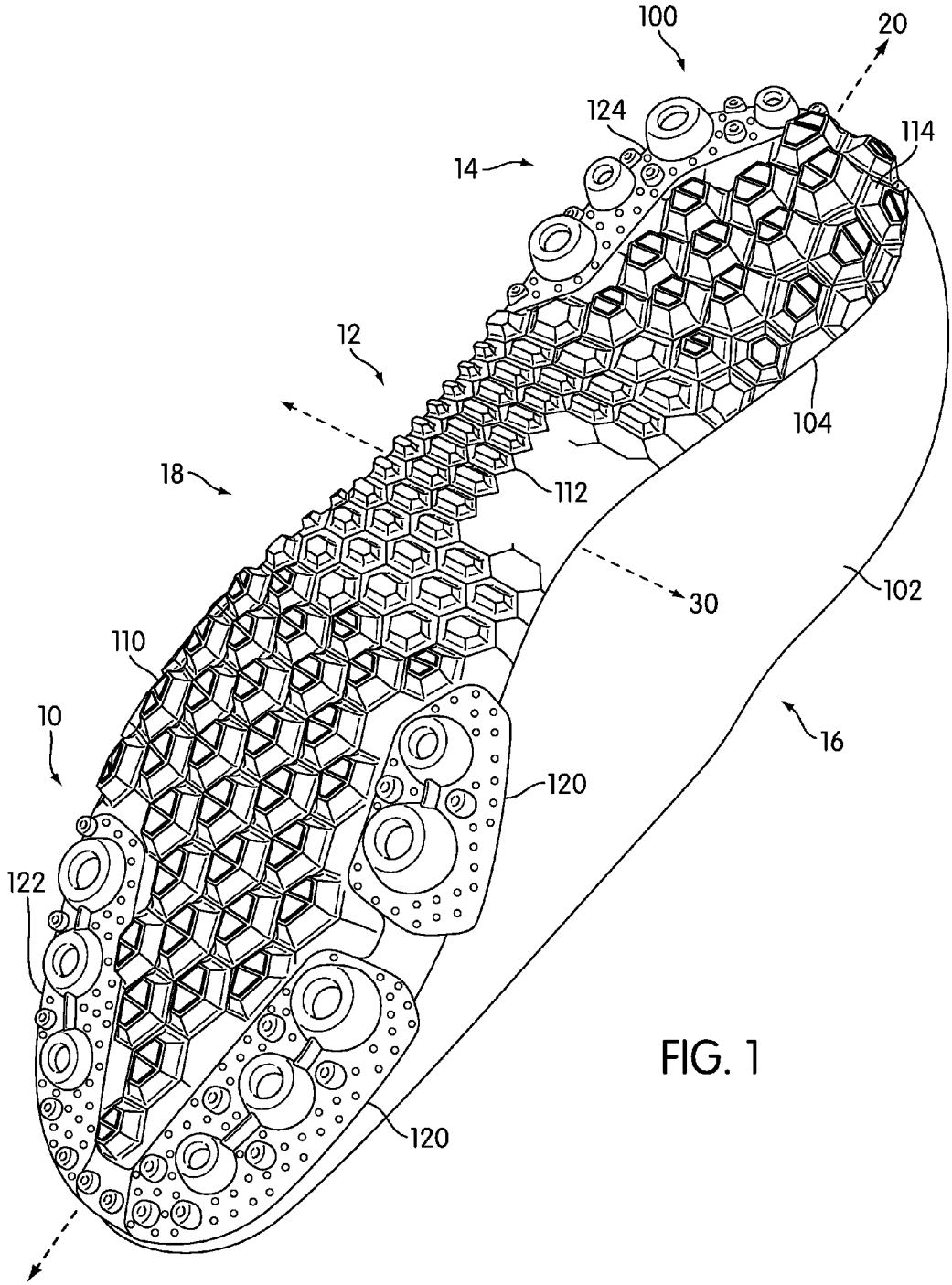
FIG. 1 is an isometric view of an exemplary embodiment of an article of footwear with multiple cleat systems.
Figure 2:
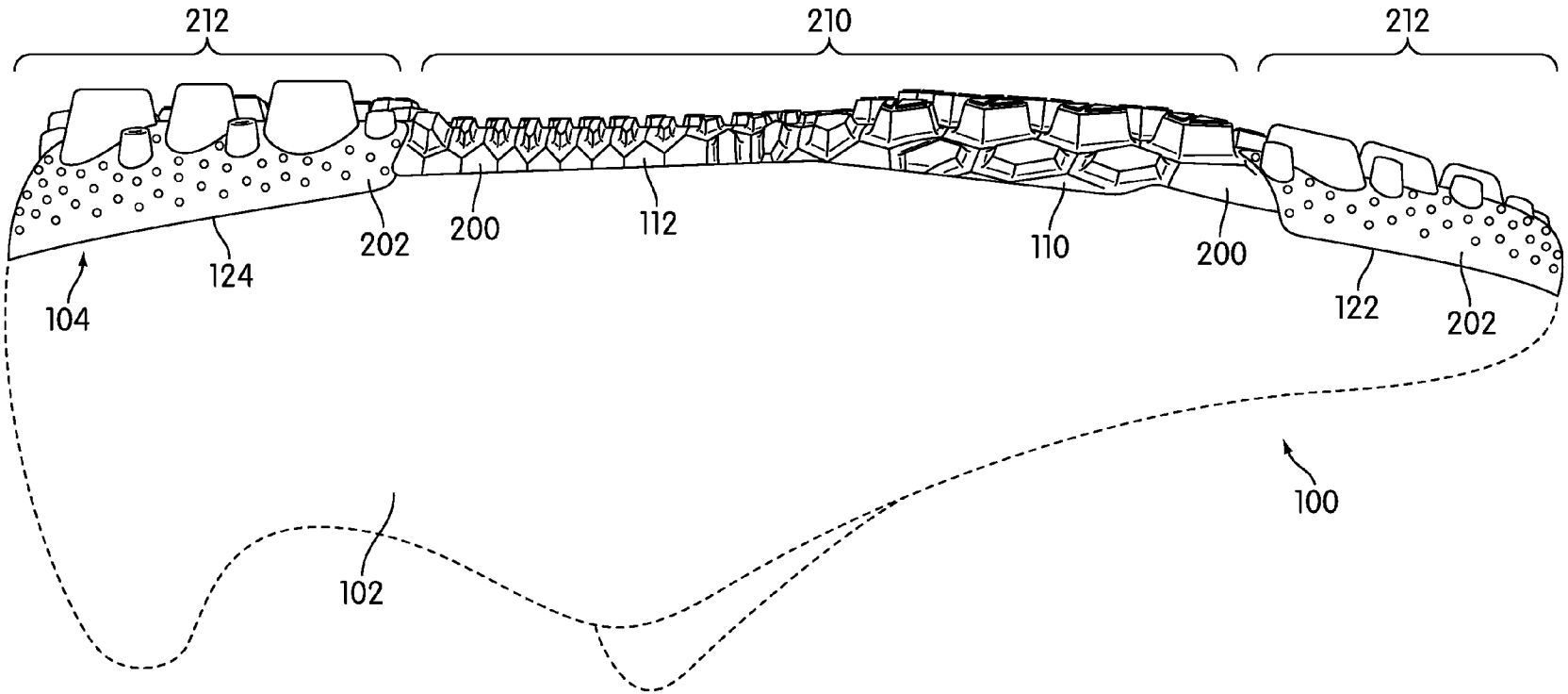
FIG. 2 is a side view of an exemplary embodiment of an article of footwear with multiple cleat systems.

FIGS. 1 and 2 illustrate views of an exemplary embodiment of article of footwear 100. For clarity, the following detailed description discusses an exemplary embodiment, in the form of a soccer shoe, but it should be noted that the present invention could take the form of any article of footwear including, but not limited to: hiking boots, soccer shoes, football shoes, sneakers, rugby shoes, basketball shoes, baseball shoes as well as other kinds of shoes. As shown in FIG. 1, article of footwear 100, also referred to simply as article 100, is intended to be used with a left foot; however, it should be understood that the following discussion may equally apply to a mirror image of article of footwear 100 that is intended for use with a right foot.

Referring to FIG. 1, for purposes of reference, article 100 may be divided into forefoot region 10, midfoot region 12, and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, article 100 may include medial side 16 and lateral side 18. In particular, medial side 16 and lateral side 18 may be opposing sides of article 100. Furthermore, both medial side 16 and lateral side 18 may extend through forefoot region 10, midfoot region 12, and heel region 14.

It will be understood that forefoot region 10, midfoot region 12, and heel region 14 are only intended for purposes of description and are not intended to demarcate precise regions of article 100. Likewise, medial side 16 and lateral side 18 are intended to represent generally two sides of an article, rather than precisely demarcating article 100 into two halves. In addition, forefoot region 10, midfoot region 12, and heel region 14, as well as medial side 16 and lateral side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

Article 100 can include upper 102. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

Article 100 can include sole structure 104. In some embodiments, sole structure 104 may be configured to provide traction for article 100. In addition to providing traction, sole structure 104 may attenuate ground reaction forces when compressed between the foot and the ground during walking, running or other ambulatory activities. The configuration of sole structure 104 may vary significantly in different embodiments to include a variety of conventional or non-conventional structures. Sole structure 104 extends between upper 102 and the ground when article 100 is worn. In different embodiments, sole structure 104 may include different components. For example, sole structure 104 may include an outsole, a midsole, and/or an insole. In some cases, one or more of these components may be optional.

In some cases, sole structure 104 may be configured according to one or more types of ground surfaces on which sole structure 104 may be used. Examples of ground surfaces include, but are not limited to: natural turf, synthetic turf, dirt, natural grass, soft natural grass, as well as other surfaces. In some embodiments, sole structure 104 may be provided with one or more cleat systems comprising a plurality of cleat members. The term "cleat members" as used in this detailed description and throughout the claims includes any provisions disposed on a sole for increasing traction through friction or penetration of a ground surface. Typically, cleat systems and/or cleat members may be configured for football, soccer, baseball or any type of activity that requires traction.

Sole structure 104 may include one or more cleat systems comprising a plurality of cleat members that extend away from sole structure 104. Generally, cleat systems and/or cleat members may be associated with sole structure 104 in any manner. In some embodiments, cleat systems and/or cleat members may be integrally formed with sole structure 104. In other embodiments, sole structure 104 may include a partially rigid plate that extends across a substantial majority of a lower surface of sole structure 104. In some cases, cleats systems and/or cleat members may be attached to a partially rigid plate, such as by being screwed into holes within the plate or using any other provisions. Still further, in some cases, some cleats systems and/or cleat members may be integrally formed with sole structure 104, while other cleat systems and/or cleat members may be attached to and/or integrally formed with a partially rigid plate.

An article of footwear including cleat systems and/or cleat members can include provisions for maximizing traction between a sole structure and multiple types of ground surfaces. In some embodiments, an article can include cleat systems and/or cleat members disposed in different locations to achieve maximum traction on multiple types of surfaces. In other embodiments, an article can include distinct types of cleat systems and/or cleat members that each maximize traction for a distinct type of surface.

Referring to FIG. 1, in some embodiments, sole structure 104 may include a forefoot cleat system 110 disposed generally in forefoot region 10, a midfoot cleat system 112 disposed generally in midfoot region 12, and/or a heel cleat system 114 disposed generally in heel region 14. Sole structure 104 additionally may include a medial forefoot cleat system 120 disposed generally on medial side 16 of forefoot region 10, a lateral forefoot cleat system 122 disposed generally on lateral side 18 of forefoot region 10, and/or a lateral heel cleat system 124 disposed generally on lateral side 18 of heel region 14. In some embodiments, medial forefoot cleat system 120 and/or lateral forefoot cleat system 122 may be disposed on an outer periphery of sole structure 104 in forefoot region 10 on, respectively, medial side 16 and lateral side 18. Similarly, lateral heel cleat system 124 may be disposed on an outer periphery of sole structure 104 in heel region 14 on lateral side 18. In other embodiments, sole structure 104 additionally may include a medial heel cleat system disposed on an outer periphery of sole structure 104 in heel region 14 on medial side 16.

In some cases, a complementary article of footwear for a right foot may include one or more of a medial forefoot cleat system, a lateral forefoot cleat system, a lateral heel cleat system and/or a medial heel cleat system. In other cases, a matching pair of articles may have cleat systems disposed on opposing sides. For example, an article for a left foot may have one or more cleat systems disposed on lateral side 18, while a matching article for a right foot may have one or more cleats systems disposed on medial side 16. In other embodiments, a matching pair of articles may have the same arrangement of one or more cleat systems on both articles. In still other embodiments, a matching pair of articles may have the same arrangement of one or more cleats systems in one region of a sole structure and have opposing arrangements of one or more cleats systems in another region of the sole structure.

Referring to FIG. 2, in some embodiments, sole structure 104 may comprise one or more cleats systems with distinct types of cleat members that have various characteristics that provide for different types of traction with a surface. Examples of different characteristics include, but are not limited to: cleat geometry, cleat height, cleat diameter, material rigidity as well as other characteristics. In some cases, sole structure 104 may comprise at least two cleat systems with distinct types of cleat members having different characteristics. In other cases, sole structure 104 may comprise three or more cleat systems with distinct types of cleat members having different characteristics. In this exemplary embodiment, sole structure 104 may comprise two cleat systems having different types of cleat members, indicated respectively as first cleat system 210 and second cleat system 212.

In this exemplary embodiment, forefoot cleat system 110, midfoot cleat system 112, and heel cleat system 114 may be associated with first cleat system 210 and medial forefoot cleat system 120, lateral forefoot cleat system 122, and lateral heel cleat system 124 may be associated with second cleat system 212.

In different embodiments, the material properties of cleat members in each respective cleat system could vary. In some embodiments, each cleat system may be associated with different rigidities. In an exemplary embodiment, first cleat system 210 may be associated with a first rigidity and second cleat system 212 may be associated with a second rigidity. In some embodiments, the second rigidity may be substantially greater than the first rigidity. In other embodiments, portions of first cleat system 210 and/or second cleat system 212 may be associated with various rigidities.

The differing rigidities first cleat system 210 and second cleat system 212 may be achieved in various ways. As an example, in the exemplary embodiment first cleat system 210 may comprise a first material 200 and second cleat system 212 may comprise a second material 202. In this case, first material 200 and second material 202 may be substantially different materials having substantially different rigidities. In particular, first material 200 may be made of a semi-rigid material, including, but not limited to rubber, hard foam, and other deformable materials. In addition, second material 202 may be a substantially rigid material, including, but not limited to plastics, polymers, nylon, polyurethane, and other rigid materials. However, it will be understood that any other materials with increasing levels of hardness could be used. In still other embodiments, it may be possible to modify the rigidity of one or more individual cleat members that comprise a cleat system by varying the geometry and/or structure of the cleat members.

By varying the rigidity of each cleat system, each cleat system may deform by a substantially different amount upon contact with a ground surface. This arrangement allows each cleat system to be tuned for maximizing traction with a different type of ground surface. In the current embodiment, first cleat system 210 may have a relatively low rigidity that is optimized for maximizing traction with a synthetic surface and second cleat system 212 may have a relatively high rigidity that is optimized for maximizing traction with soft natural grass. In other embodiments, first cleat system 210 may have an intermediate rigidity that is optimized for maximizing traction with firm natural grass. In addition, in other embodiments, first cleat system 210 and/or second cleat system 212 may have portions with varying levels of rigidity.

Figure 3:
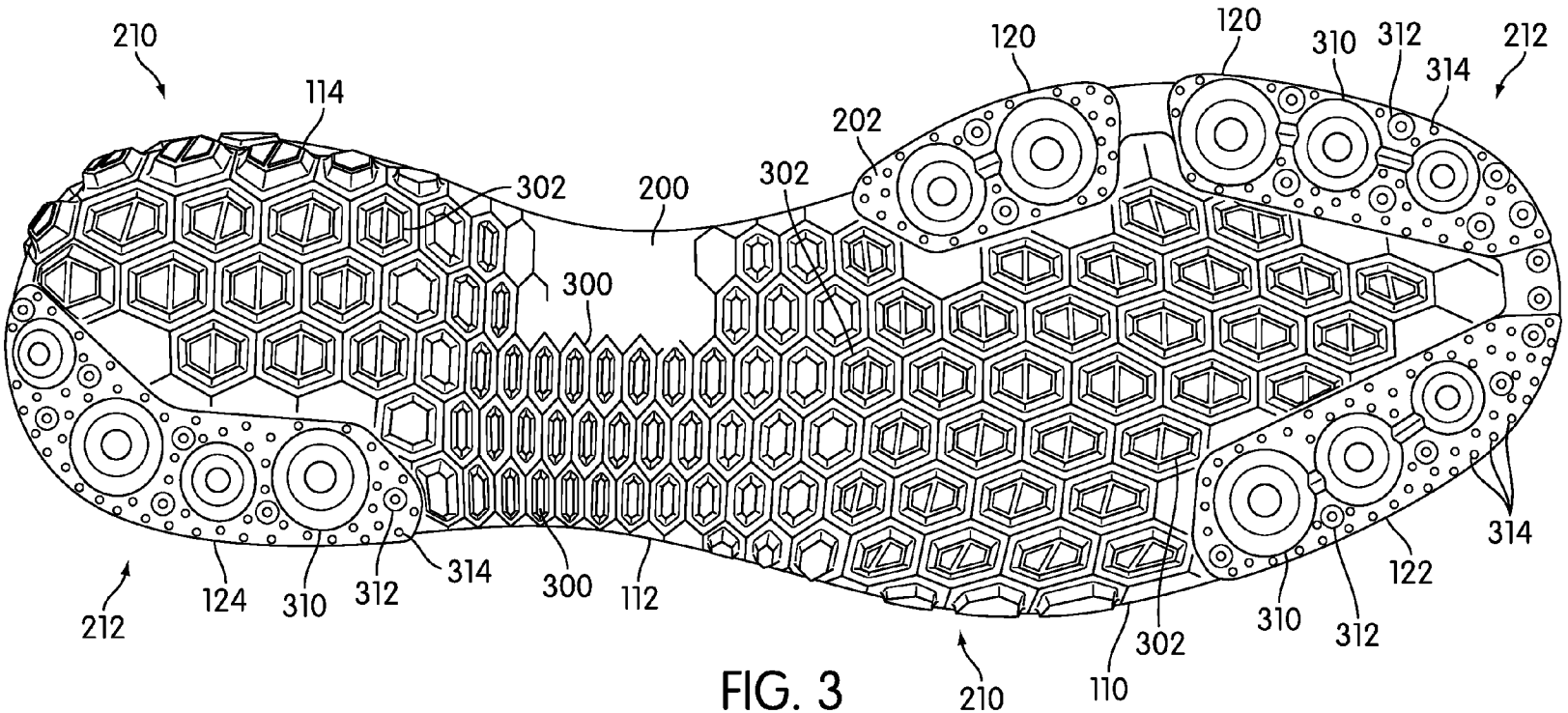
FIG. 3 is a top view of an embodiment of a sole structure of an article of footwear comprising multiple cleat systems.

Referring now to FIG. 3, each of first cleat system 210 and second cleat system 212 may be distinguished according to various cleat designs such as size, shape, and/or material properties. For example, in some cases, each cleat system may comprise cleat members of distinct sizes. In other cases, each cleat system may comprise cleat members of distinct material properties. In still other cases, each cleat system may comprise cleat members of distinct shape and/or geometries. In different embodiments, each cleat system may comprise cleat members with various combinations of different sizes, shapes, and/or material properties.

In some embodiments, individual cleat members of first cleat system 210 may be provided with a design of an approximately hexagonal shape. For example, in the current embodiment, midfoot cleat system 112 of first cleat system 210 may include a plurality of cleat members with a first hexagonal shape 300. Similarly, forefoot cleat system 110 and/or heel cleat system 114 associated with first cleat system 210 may include a plurality of cleat members with a second hexagonal shape 302.

In some embodiments, individual cleat members of second cleat system 212 may be provided with a design of an approximately round cross-sectional shape. For example, in the current embodiment, medial forefoot cleat system 120, lateral forefoot cleat system 122, and/or lateral heel cleat system 124 associated with second cleat system 212 may include a plurality of cleat members with a conical shape 310, a plurality of cleat members with a cylindrical shape 312, and/or a plurality of cleat members with a round or domed shape 314. In other embodiments, cleat members 314 may be comprised of a bump or other raised element comprised of any shape. In some cases, cleat members 314 may further be associated with a raised portion connecting the plurality of cleat members 314. In other cases, cleat members 314 may be optional and the space between conical cleat members 310 and cylindrical cleat members 312 may be smooth.

Additionally, it will be understood that while the current embodiments use hexagonal and/or round cross-sectional shaped cleat members, cleat members may be formed in any of various shapes, including but not limited to hexagonal, cylindrical, conical, circular, square, rectangular, trapezoidal, diamond, ovoid, as well as other regular or irregular and geometric or non-geometric shapes.

FIGS. 4 through 13 illustrate views of an exemplary embodiment of first cleat system 210. First cleat system 210 may have a plurality of cleat members with an approximately hexagonal shape. In some embodiments, first cleat system 210 may include one or more cleat member sets with different hexagonal designs. Cleat member sets may include cleat members that vary in size in different dimensional directions. It should be understood that the terms "length" and "width" as used throughout this detailed description and in the claims refers to a direction generally associated with the longest and shortest dimensions, respectively, of an element in the plane parallel to the sole structure. It should also be understood that the term "height" as used throughout this detailed description and in the claims refers to a direction generally associated with the distance of an element as measured from the sole structure in the plane perpendicular to the sole structure.

Figure 4:
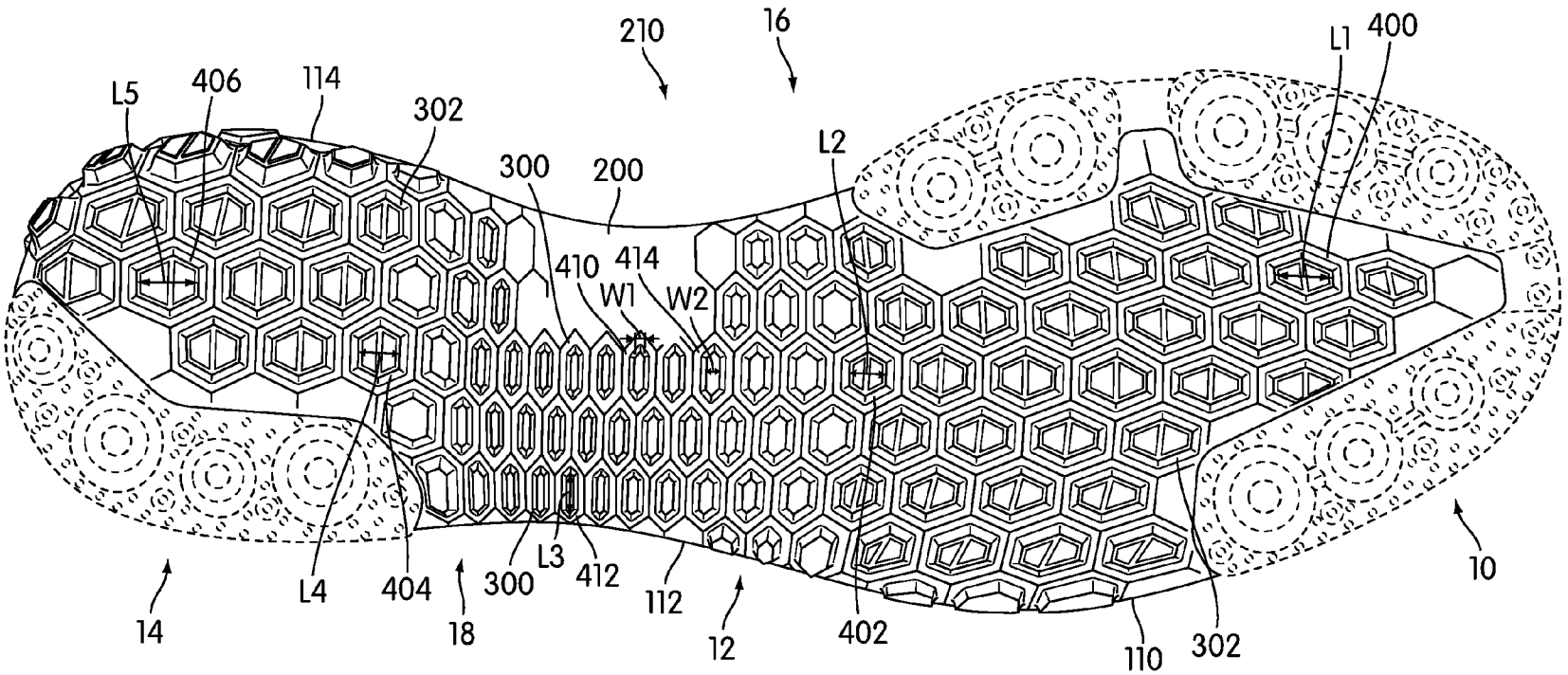
FIG. 4 is a plan view of an exemplary embodiment of a cleat system with a hexagonal cleat design.

Referring to FIG. 4, in this embodiment, first cleat system 210 includes a first cleat member set with a plurality of cleat members that have a length that is substantially oriented along longitudinal axis 20 of article 100. In an exemplary embodiment, the first cleat member set may include one or more second hexagonal cleat members 302 located in portions of forefoot cleat system 110 and/or heel cleat system 114. In this embodiment, the first cleat member set includes a first longitudinal hexagon cleat 400, a second longitudinal hexagon cleat 402, a third longitudinal hexagon cleat 404, and a fourth longitudinal hexagon cleat 406.

Similarly, first cleat system 210 may include a second cleat member set with a plurality of cleat members that have a length that is substantially oriented along lateral axis 30 of article 100. In an exemplary embodiment, the second cleat member set may include one or more first hexagonal cleat members 300 located in portions of midfoot cleat system 112. In this embodiment, the second cleat member set includes a first lateral hexagon cleat 410, a second lateral hexagon cleat 412, and a third lateral hexagon cleat 414. With this arrangement of hexagonal cleat members 300 having a length that is substantially oriented along lateral axis 30 of article 100, sole structure 104 may have flexibility in midfoot region 12. In some embodiments, the lateral axis orientation of the cleat members in the midfoot region may allow for bending of the sole structure in a region generally corresponding to an arch of a foot of the wearer of article 100.

In some embodiments, the length and/or width of cleat members in each cleat member set may vary. In this embodiment, the length of cleat members in the first cleat member set may vary. In an exemplary embodiment, first longitudinal hexagon cleat 400 may be associated with a first length L1, second longitudinal hexagon cleat 402 may be associated with a second length L2, third longitudinal hexagon cleat 404 may be associated with a fourth length L4, and fourth longitudinal hexagon cleat 406 may be associated with a fifth length L5. In addition, second lateral hexagon cleat 412 may be associated with a third length L3.

Similarly, in this embodiment, the width of cleat members in the second cleat member set may vary. In an exemplary embodiment, first lateral hexagon cleat 410 may be associated with a first width W1 and third lateral hexagon cleat 414 may be associated with a second width W2. In other embodiments, the length and/or width of any individual cleat member associated with first hexagonal cleat members 300 and/or second hexagonal cleat members 302 may vary.

Figure 5:
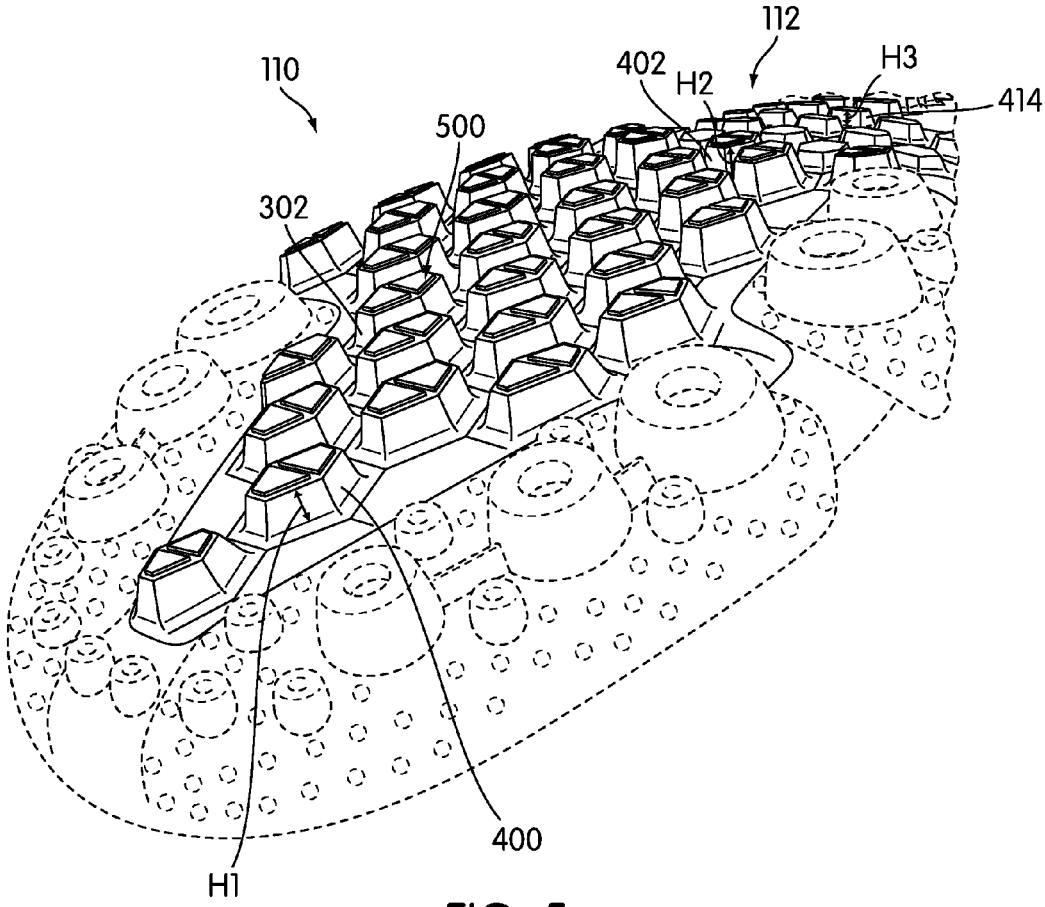
FIG. 5 is an enlarged isometric view of an exemplary embodiment of a forefoot region of a cleat system with a hexagonal cleat design.

In different embodiments, the approximate heights of cleat members in a cleat member set and/or cleat system may vary. In some embodiments, the height of cleat members associated with the first cleat member set and/or the second cleat member set may vary. FIG. 5 illustrates an isometric view of forefoot cleat system 110 and a portion of midfoot cleat system 112. In the current embodiment, the first cleat member set may be represented by first longitudinal hexagon cleat 400 and second longitudinal hexagon cleat 402. Similarly, the second cleat member set may be represented by third lateral hexagon cleat 414. In other words, each cleat member of first cleat member set may have a height that is substantially similar to that of first longitudinal hexagon cleat 400 and/or second longitudinal hexagon cleat 402. Likewise, each cleat member of the second cleat member set may have a height that is substantially similar to that of third lateral hexagon cleat 414. In other embodiments, cleat members of the first cleat member set and/or the second cleat member set may have variations of heights within the same cleat member set.

In this exemplary embodiment, first longitudinal hexagon cleat 400 may be associated with a first height H1 and second longitudinal hexagon cleat 402 may be associated with a second height H2. Likewise, third lateral hexagon cleat 414 may be associated with a third height H3.

By using cleat member sets with cleat members of increasing height, the depth of penetration of each cleat member set into a ground surface may vary so that each cleat can be tuned to provide maximum traction for a different type of surface. In the current embodiment, the first cleat member set may have a relatively large height that is optimized for maximizing traction with a synthetic surface. Furthermore, second cleat member 140 may have a smaller sized height that is optimized for maximizing traction with natural grass.

Figure 6:
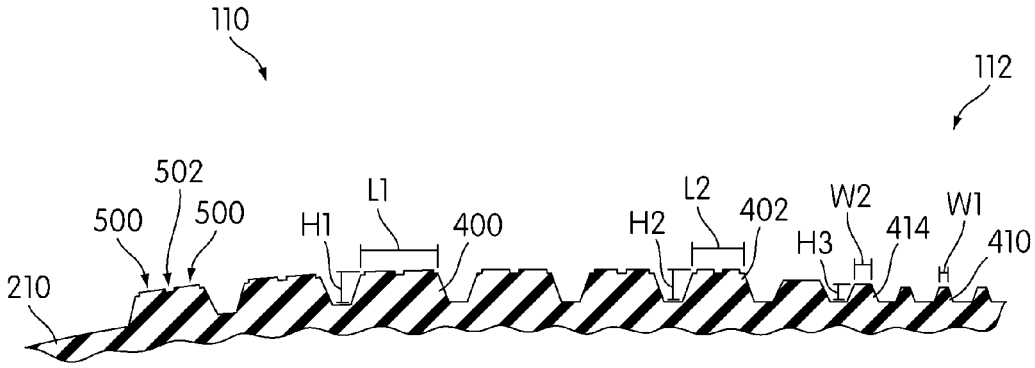
FIG. 6 is a cross sectional view of an exemplary embodiment of a forefoot region of a cleat system with a hexagonal cleat design.

In some embodiments, cleat members associated with the first cleat member set may include additional elements for providing traction. In an exemplary embodiment, the first cleat member set may include one or more second hexagonal cleat members 302 with a gripping member 500 disposed on a ground-engaging end of the cleat member. As shown in FIG. 6, gripping member 500 may comprise a raised element with a groove 502 between portions of gripping member 500. Groove 502 may provide a channel for water or other material disposed on a playing surface to move out from under the cleat member when article 100 is worn.

FIG. 6 illustrates a cross sectional view of first cleat system 210. In this embodiment, the first cleat member set may be represented by first longitudinal hexagon cleat 400 with first height H1 and first length L1 and second longitudinal hexagon cleat 402 with second height H2 and second length L2. Similarly, the second cleat member set may be represented by third lateral hexagon cleat 414 with third height H3 and second width W2 and first lateral hexagon cleat 410 with first width W1. In some embodiments, first height H1 and second height H2 may be substantially similar. In this embodiment first height H1 and/or second height H2 are substantially larger than third height H3. In other embodiments, first height H1 may be larger than second height H2 and second height H2 may be larger than third height H3. In some embodiments, first lateral hexagon cleat 410 may be associated with a height that is substantially similar to third height H3. In other embodiments, first lateral hexagon cleat 410 may be associated with a height that is smaller than third height H3. In one exemplary embodiment, first height H1, second height H2, and third height H3 gradually decrease from the distal end near forefoot region 10 towards the proximal end near midfoot region 12. In other embodiments, the height of cleat members may decrease in correspondence with the proximity to midfoot region 12.

In different embodiments, the values of first height H1, second height H2 and third height H3 may vary. In some embodiments, first height H1 may have a value approximately in the range between 6 mm and 14 mm. Also, second height H2 may have a value approximately in the range between 5 mm and 14 mm. In addition, third height H3 may have a value approximately in the range between 3 mm and 7 mm. In an exemplary embodiment, height H1, height H2 and height H3 may have approximate values of 10 mm, 8 mm and 4 mm, respectively. In other embodiments, however, first height H1, second height H2 and third height H3 may have any other values.

In some embodiments, first length L1 may be substantially larger than second length L2. In some cases, the length of cleat members may gradually decrease from the distal end near forefoot region 10 towards the proximal end near midfoot region 12. In other embodiments, the length of cleat members, including first length L1 and second L2, may decrease in correspondence with the proximity to midfoot region 12. In still other embodiments, first length L1 and second length L2 may be substantially similar.

In this embodiment, first length L1 and/or second length L2 are substantially larger than both first width W1 and second width W2. In some embodiments, second width W2 may be substantially larger than first width W1. In other embodiments, second width W2 and first width W1 may be substantially similar. In still other embodiments, first length L1 may be substantially larger than first width W1 and second width W2, while second length L2 may be slightly larger than second width W2 and substantially larger than first width W1. In one exemplary embodiment, first length L1, second length L2, second width W2, and first width W1 gradually decrease from the distal end near forefoot region 10 towards the proximal end near midfoot region 12.

In different embodiments, the values of first length L1, second length L2, first width W1, and second width W2 may vary. In some embodiments, first length L1 may have a value approximately in the range between 5 mm and 14 mm. Also, second length L2 may have a value approximately in the range between 4 mm and 10 mm. In addition, first width W1 may have a value approximately in the range between 1 mm and 3 mm. Also, second width W2 may have a value approximately in the range between 2 mm and 4 mm. In an exemplary embodiment, first length L1, second length L2, first width W1, and second width W2 may have approximate values of 12 mm, 8 mm, 4 mm, and 2 mm, respectively. In other embodiments, however, first length L1, second length L2, first width W1, and second width W2 may have any other values.

Figure 7:
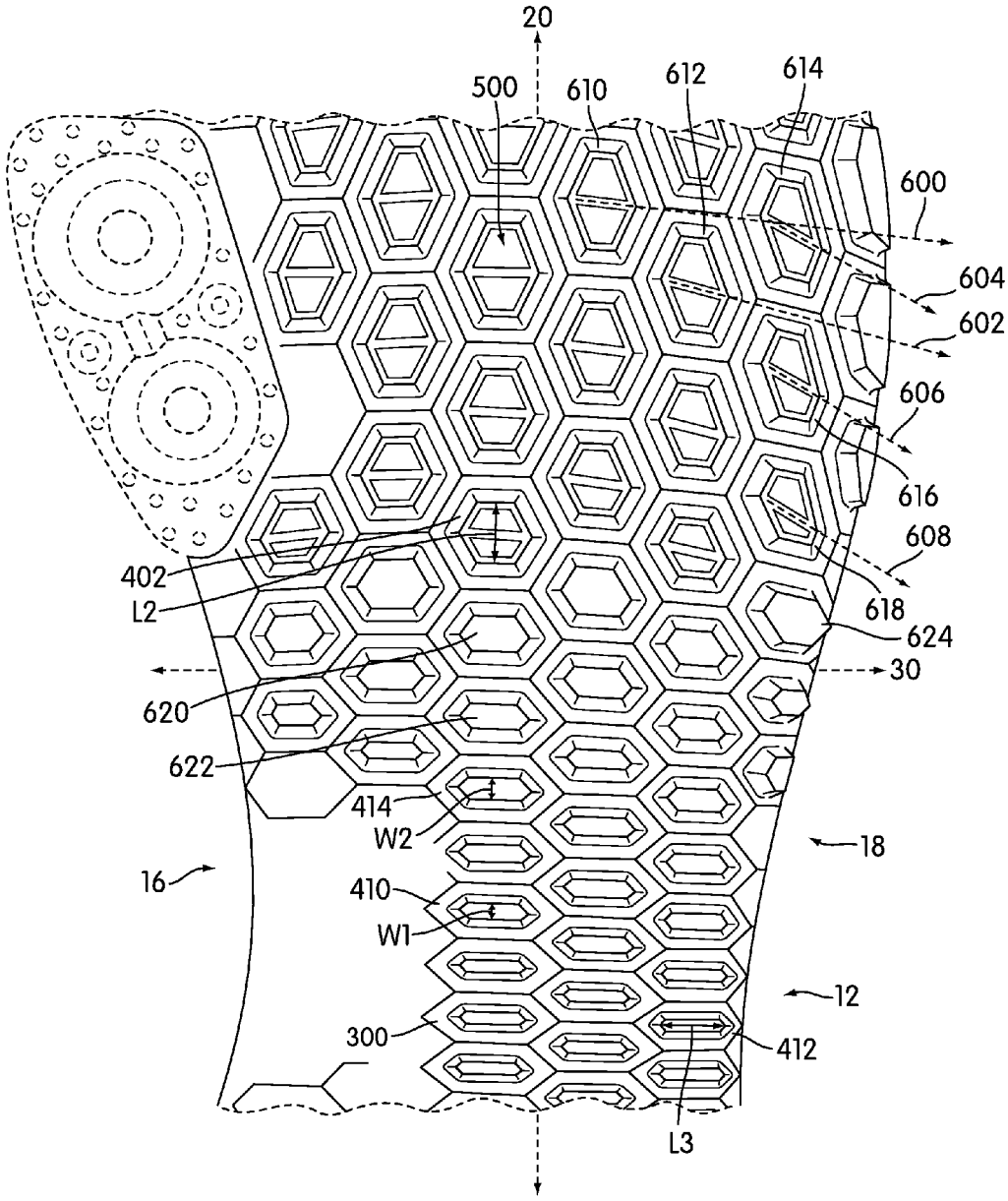
FIG. 7 is an enlarged top view of an exemplary embodiment of a cleat system with a hexagonal cleat design.
Figure 8:
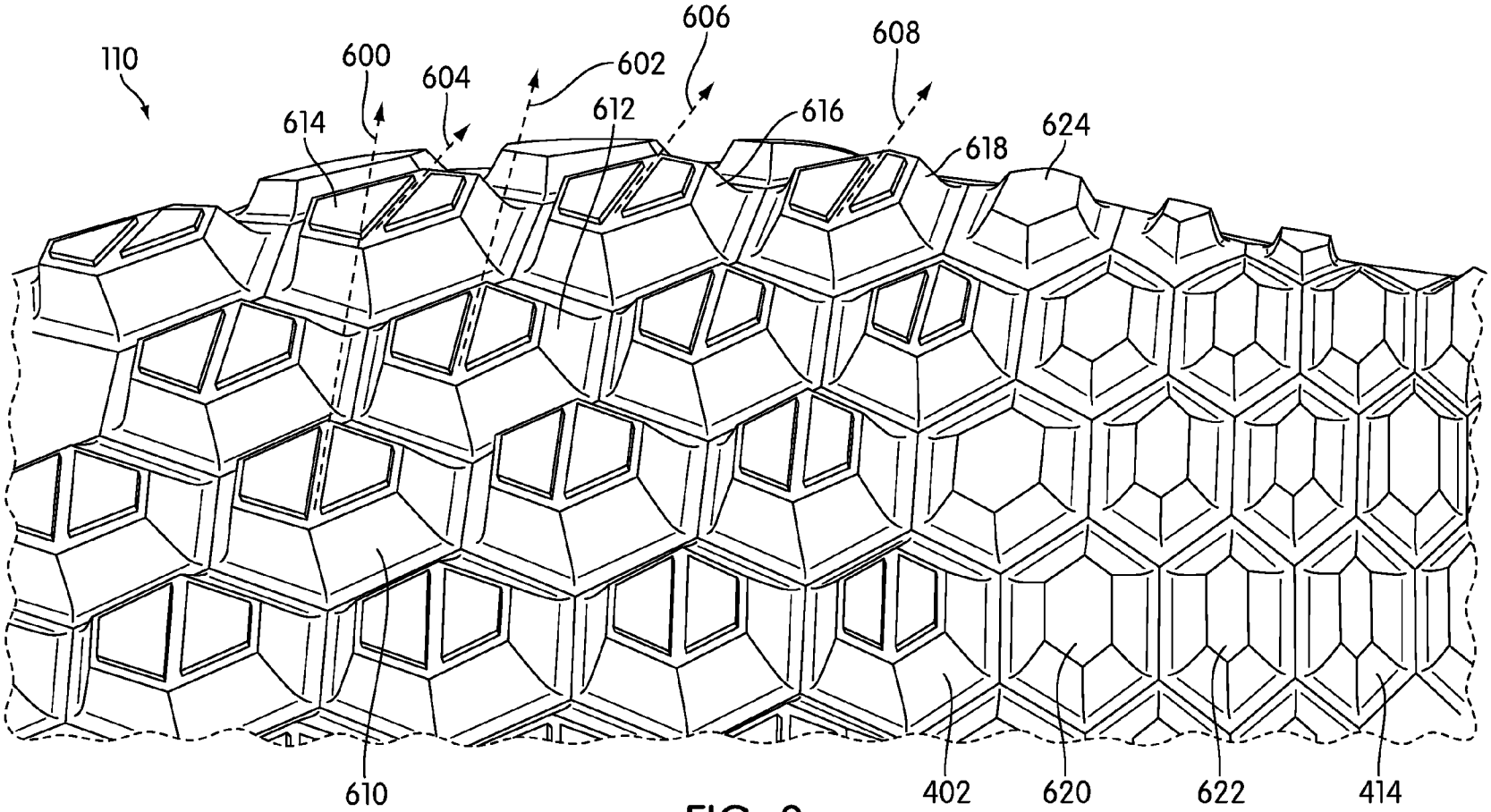
FIG. 8 is an enlarged isometric view of a side of an exemplary embodiment of a cleat system with a hexagonal cleat design.

Referring now to FIGS. 7 and 8, an enlarged view of an exemplary embodiment of first cleat system 210 is illustrated. In some embodiments, the first cleat member set with a plurality of cleat members that have a length that is substantially oriented along longitudinal axis 20 of article 100 may gradually transition into the second cleat member set with a plurality of cleat members that have a length that is substantially oriented along lateral axis 30 of article 100 near midfoot region 12. Referring to FIG. 7, in this embodiment, a plurality of cleat members transition orientation from having a length oriented along longitudinal axis 20 to having a length oriented along lateral axis 30. In this embodiment, first transition hexagon cleat 620 and second transition hexagon cleat 622 represent the plurality of cleat members that transition orientation from longitudinal axis 20 to lateral axis 30.

As shown in FIG. 7, first transition hexagon cleat 620 has a length that is slightly greater along lateral axis 30 than longitudinal axis 20. Similarly, second transition hexagon cleat 622 has a length that is even greater along lateral axis 30 than longitudinal axis 20. In this way, as shown in FIGS. 7 and 8, the first cleat member set may transition from second longitudinal hexagon cleat 402 to first transition hexagon cleat 620 to second transition hexagon cleat 622, and finally to the second cleat member set, including third lateral hexagon cleat 414 and first lateral hexagon cleat 410. In some embodiments, this arrangement may provide greater flexibility to midfoot region 12 of sole structure 104 than the flexibility associated with forefoot region 10.

In some embodiments, one or more cleat members associated with the first cleat member set may have a shifted lateral axis in portions of forefoot cleat system 110. With this arrangement, cleat members with a shifted lateral axis may provide enhanced traction to portions of sole structure 104 and/or mitigate forces associated with movements of a foot of a wearer. In this embodiment, a first shifted cleat member 610, a second shifted cleat member 612, a third shifted cleat member 614, a fourth shifted cleat member 616, and a fifth shifted cleat member 618 each have a lateral axis that is skewed towards midfoot region 12. Particularly, as shown in FIGS. 7 and 8, first shifted cleat member 610 may be associated with a first shifted axis 600, second shifted cleat member 612 may be associated with a second shifted axis 602, third shifted cleat member 614 may be associated with a third shifted axis 604, fourth shifted cleat member 616 may be associated with a fourth shifted axis 606, and fifth shifted cleat member 618 may be associated with a fifth shifted axis 608.

In some embodiments, shifted cleat members may be skewed towards midfoot region 12 in greater degree in correspondence with the proximity of the cleat member to the edge on lateral side 18. In this embodiment, second shifted cleat member 612 is located closer to the lateral edge than first shifted cleat member 610 and second shifted axis 602 is skewed towards midfoot region 12 in a greater degree than first shifted axis 600. Similarly, third shifted cleat member 614 may be closer to the lateral edge than second shifted cleat member 612. As a result, third shifted axis 604 may be skewed towards midfoot region 12 in a greater degree than second shifted axis 602. In addition, third shifted axis 604 may be skewed towards midfoot region 12 in a substantially greater degree than first shifted axis 600. In this embodiment, third shifted cleat member 614, fourth shifted cleat member 616, and fifth shifted cleat member 618 may be generally located with substantially similar proximity to the lateral edge. Accordingly, in this embodiment, third shifted axis 604, fourth shifted axis 606, and fifth shifted axis 608 may be skewed towards midfoot region 12 in a substantially similar degree.

Additionally, in some embodiments, shifted cleat members may include one or more cleat members that transition orientation from having a length oriented along longitudinal axis 20 to having a length oriented along lateral axis 30 as previously discussed. In this embodiment, shifted cleat members may include a third transition hexagon cleat 624 along lateral side 18. In different embodiments, one or more shifted cleat members also may gradually transition orientation from the first cleat member set to the second cleat member set as discussed above.

In other embodiments, any one or more of the shifted cleat members may be skewed towards midfoot region 12 in greater degree in correspondence with the proximity of the cleat member to the edge on medial side 16. In still other embodiments, any one or more of the shifted cleat members may be skewed towards midfoot region 12 in substantially similar degree independently of proximity to the lateral edge and/or medial edge. In other cases, shifted cleat members may have a skewed longitudinal axis. In different embodiments, the shifted cleat members may be skewed towards different regions of sole structure 104, including forefoot region 10, midfoot region 12, and/or heel region 14.

FIGS. 9 through 13 illustrate different views of heel cleat system 114 and a portion of midfoot cleat system 112.

Figure 9:
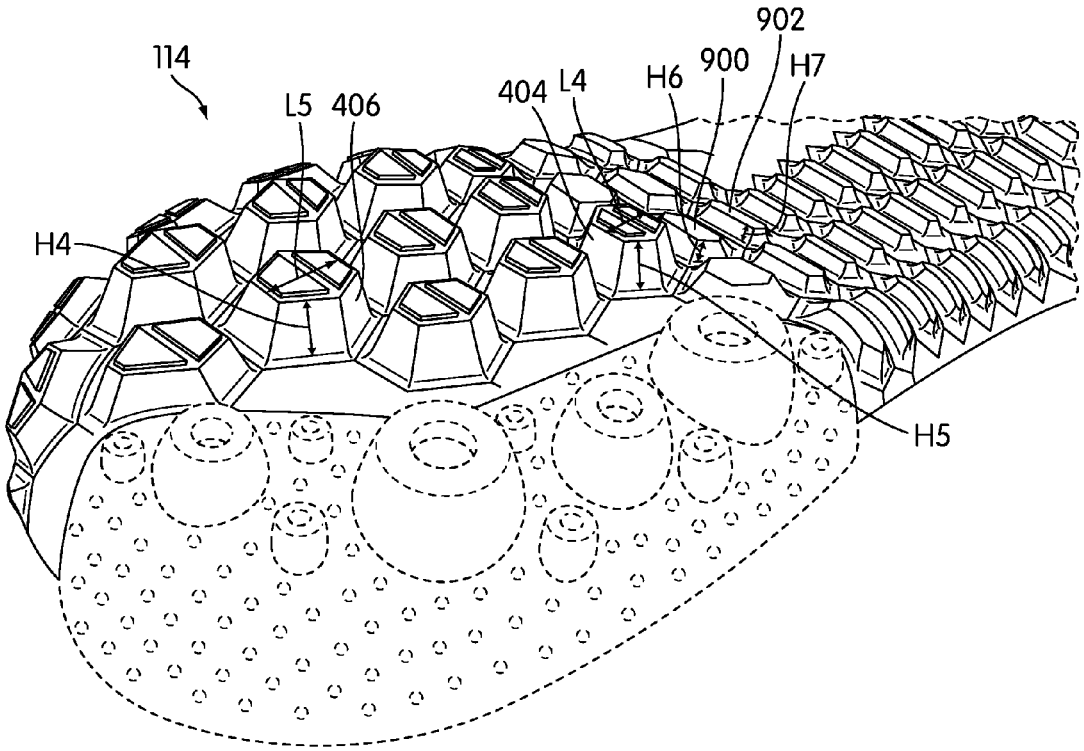
FIG. 9 is an enlarged isometric view of an exemplary embodiment of a heel region of a cleat system with a hexagonal cleat design.
Figure 10:
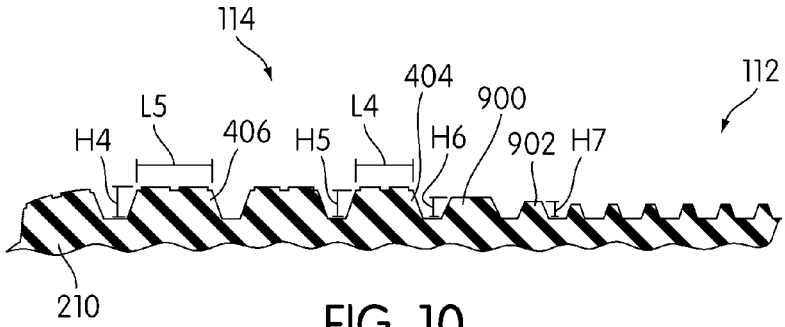
FIG. 10 is a cross sectional view of an exemplary embodiment of a heel region of a cleat system with a hexagonal cleat design.

Referring to FIGS. 9 and 10, in some embodiments, the height of cleat members associated with the first cleat member set and/or the second cleat member set may vary. In the current embodiment, the first cleat member set may be represented by third longitudinal hexagon cleat 404 and fourth longitudinal hexagon cleat 406. In other words, each cleat member of first cleat member set may have a height that is substantially similar to that of third longitudinal hexagon cleat 404 and/or fourth longitudinal hexagon cleat 406. Similarly, the second cleat member set may be represented by one or more first hexagonal cleat members 300 and each cleat member of the second cleat member set may have a height that is substantially similar to that of first lateral hexagon cleat 410, previously discussed. In other embodiments, cleat members of the first cleat member set and/or the second cleat member set may have variations of heights within the same cleat member set.

FIG. 10 illustrates a cross sectional view of first cleat system 210. In this exemplary embodiment, fourth longitudinal hexagon cleat 406 may be associated with a fourth height H4 and third longitudinal hexagon cleat 404 may be associated with a fifth height H5. In some embodiments, one or more cleat members may gradually transition from the first cleat member set into the second cleat member set, as previously discussed. In this embodiment, a fourth transition hexagon cleat 900 may be associated with a sixth height H6 and a fifth transition hexagon cleat 902 may be associated with a seventh height H7. In this exemplary embodiment, sixth height H6 and/or seventh height H7 generally may be slightly larger than the height associated with first hexagonal cleat members 300, including third height H3 of third lateral hexagon cleat 414, previously discussed. In other embodiments, sixth height H6, seventh height H7, and/or third height H3 may be substantially similar.

In some embodiments, fourth height H4 and fifth height H5 may be substantially similar. In this embodiment fourth height H4 and/or fifth height H5 are substantially larger than sixth height H6 and seventh height H7. In other embodiments, fourth height H4 may be larger than fifth height H5 and fifth height H5 may be larger than sixth height H6 and seventh height H7. In one exemplary embodiment, fourth height H4, fifth height H5, sixth height H6, and seventh height H7 gradually decrease from the distal end near heel region 14 towards the proximal end near midfoot region 12. In other embodiments, the height of cleat members may decrease in correspondence with the proximity to midfoot region 12.

In different embodiments, the values of fourth height H4, fifth height H5, sixth height H6, and seventh height H7 may vary. In some embodiments, fourth height H4 may have a value approximately in the range between 6 mm and 14 mm. Also, fifth height H5 may have a value approximately in the range between 5 mm and 14 mm. In addition, sixth height H6 may have a value approximately in the range between 3 mm and 7 mm. Also, seventh height H7 may have a value approximately in the range between 3 mm and 7 mm. In an exemplary embodiment, fourth height H4, fifth height H5, sixth height H6, and seventh height H7 may have approximate values of 10 mm, 8 mm, 4 mm, and 3 mm, respectively. In other embodiments, however, fourth height H4, fifth height H5, sixth height H6, and seventh height H7 may have any other values.

In one exemplary embodiment, fourth longitudinal hexagon cleat 406 may be associated with fifth length L5 and third longitudinal hexagon cleat 404 may be associated with fourth length L4, as previously discussed. In some embodiments, fifth length L5 may be substantially larger than fourth length L4. In some cases, the length of cleat members may gradually decrease from the distal end near heel region 14 towards the proximal end near midfoot region 12. In other embodiments, the length of cleat members, including fifth length L5 and fourth length L4, may decrease in correspondence with the proximity to midfoot region 12. In still other embodiments, fifth length L5 and fourth length L4 may be substantially similar.

In this embodiment, fifth length L5 and/or fourth length L4 are substantially larger than widths associated with fourth transition hexagon cleat 900 and/or fifth transition hexagon cleat 902. In some embodiments, fourth transition hexagon cleat 900 may have a width that is substantially larger than first width W1 and/or second width W2, previously discussed and fifth transition hexagon cleat 902 may have a width that is slight larger or substantially similar to first width W1 and/or second width W2. In other embodiments, the widths of fourth transition hexagon cleat 900 and fifth transition hexagon cleat 902 may be substantially similar to first width W1 and/or second width W2. In one exemplary embodiment, fifth length L5, fourth length L4, and the widths associated with fourth transition hexagon cleat 900 and fifth transition hexagon cleat 902 may gradually decrease from the distal end near heel region 14 towards the proximal end near midfoot region 12.

In different embodiments, the values of fourth length L4 and fifth length L5 may vary. In some embodiments, fourth length L4 may have a value approximately in the range between 5 mm and 14 mm. Also, fifth length L5 may have a value approximately in the range between 4 mm and 10 mm. In an exemplary embodiment, fourth length L4 and fifth length L5 may have approximate values of 12 mm and 8 mm, respectively. In other embodiments, however, fourth length L4 and fifth length L5 may have any other values.

Figure 11:
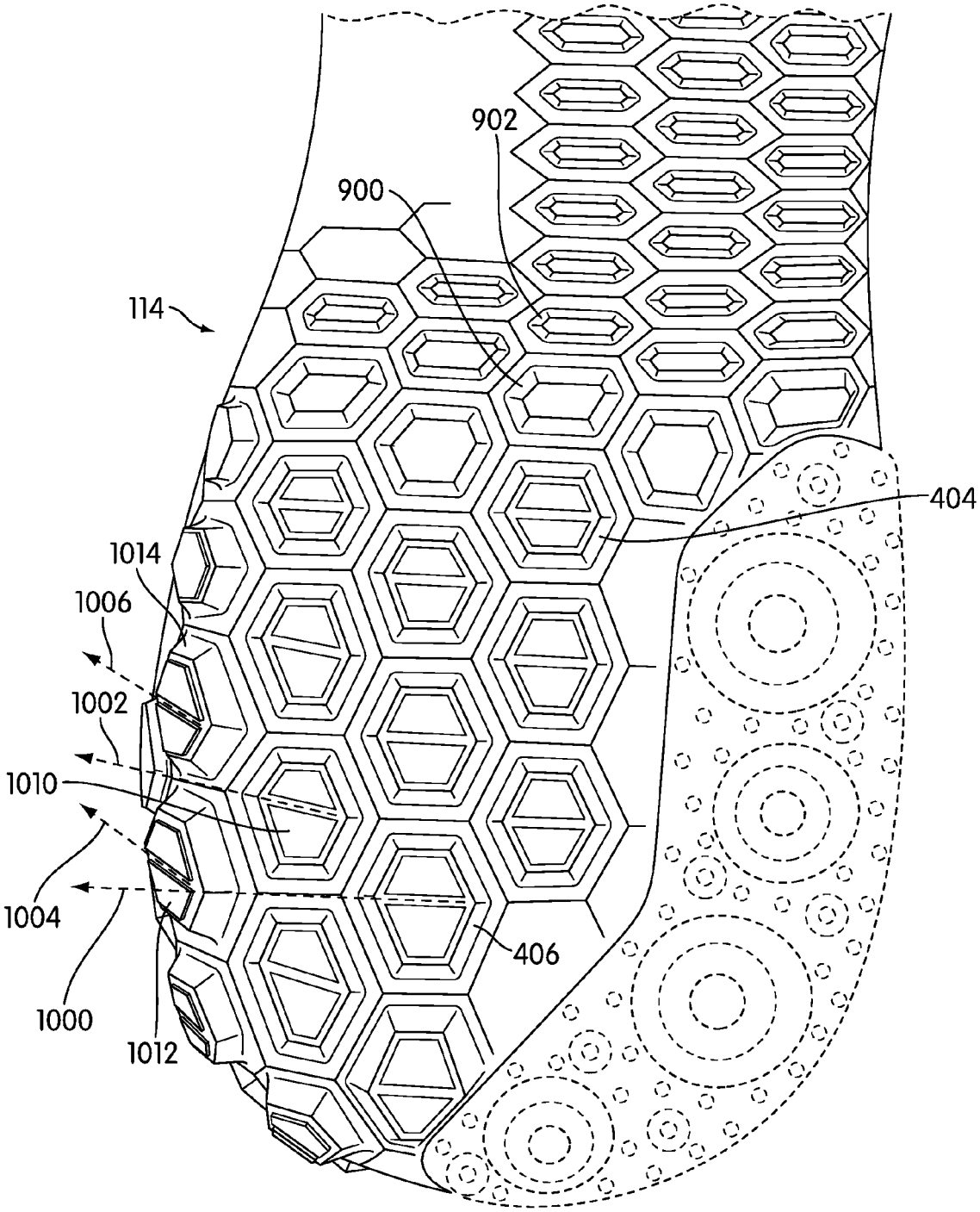
FIG. 11 is an enlarged top view of an exemplary embodiment of a cleat system with a hexagonal cleat design.

Referring now to FIG. 11, in some embodiments, the first cleat member set with a plurality of cleat members that have a length that is substantially oriented along longitudinal axis 20 of article 100 may gradually transition into the second cleat member set with a plurality of cleat members that have a length that is substantially oriented along lateral axis 30 of article 100 near midfoot region 12, as previously discussed in connection with forefoot region 10 and FIGS. 7 and 8 described above. As shown in FIG. 11, in this embodiment, a plurality of cleat members associated with heel cleat system 114 may transition orientation from having a length oriented along longitudinal axis 20 to having a length oriented along lateral axis 30. In this embodiment, fourth transition hexagon cleat 900 and fifth transition hexagon cleat 902 represent the plurality of cleat members that transition orientation from longitudinal axis 20 to lateral axis 30.

As shown in FIG. 11, fourth transition hexagon cleat 900 has a length that is slightly greater along lateral axis 30 than longitudinal axis 20. Similarly, fifth transition hexagon cleat 902 has a length that is even greater along lateral axis 30 than longitudinal axis 20. In this way, as shown in FIGS. 9 through 11, the first cleat member set may transition from third longitudinal hexagon cleat 404 to fourth transition hexagon cleat 900 to fifth transition hexagon cleat 902, and finally to the second cleat member set. In some embodiments, this arrangement may provide greater flexibility to midfoot region 12 of sole structure 104 than the flexibility associated with heel region 14.

Figure 12:
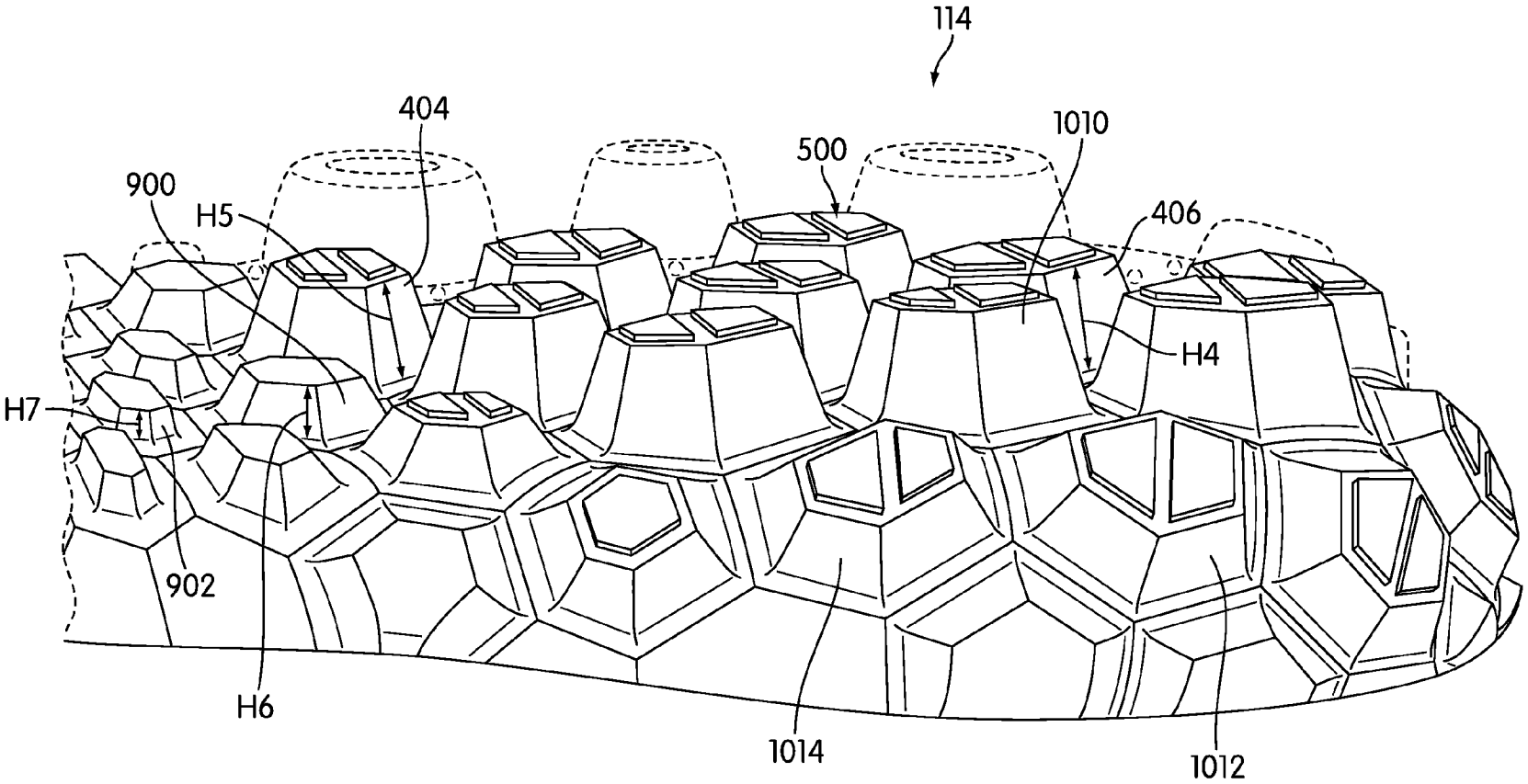
FIG. 12 is an enlarged side view of an exemplary embodiment of a cleat system with a hexagonal cleat design.

Referring to FIGS. 11 and 12, in some embodiments, one or more cleat members associated with the first cleat member set may have a shifted lateral axis in portions of heel cleat system 114. With this arrangement, cleat members with a shifted lateral axis may provide enhanced traction to portions of sole structure 104 and/or mitigate forces associated with movements of a foot of a wearer. In this embodiment, a first shifted heel cleat member 1010, a second shifted heel cleat member 1012, and a third shifted heel cleat member 1014 each have a lateral axis that is skewed towards midfoot region 12. Particularly, as shown in FIGS. 11 and 12, fourth longitudinal hexagon cleat 406 may be associated with a first heel axis 1000, first shifted heel cleat member 1010 may be associated with a first shifted heel axis 1002, second shifted heel cleat member 1012 may be associated with a second shifted heel axis 1004, and third shifted heel cleat member 614 may be associated with a third shifted heel axis 1006.

In some embodiments, shifted cleat members may be skewed towards midfoot region 12 in greater degree in correspondence with the proximity of the cleat member to the edge on medial side 16. In this embodiment, first shifted heel cleat member 1010 is located closer to the medial edge than fourth longitudinal hexagon cleat 406 and first shifted heel axis 1002 is skewed towards midfoot region 12 in a greater degree than first heel axis 1000. Similarly, second shifted heel cleat member 1012 may be closer to the medial edge than first shifted heel cleat member 1010. As a result, second shifted heel axis 1004 may be skewed towards midfoot region 12 in a greater degree than first shifted heel axis 1002. In addition, second shifted heel axis 1004 may be skewed towards midfoot region 12 in a substantially greater degree than first heel axis 1000. In this embodiment, second shifted heel cleat member 1012 and third shifted heel cleat member 1014 may be generally located with substantially similar proximity to the medial edge. Accordingly, in this embodiment, second shifted heel axis 1004 and third shifted heel axis 1006 may be skewed towards midfoot region 12 in a substantially similar degree.

Additionally, in some embodiments, shifted cleat members may include one or more cleat members that transition orientation from having a length oriented along longitudinal axis 20 to having a length oriented along lateral axis 30 as previously discussed.

In other embodiments, any one or more of the shifted cleat members may be skewed towards midfoot region 12 in greater degree in correspondence with the proximity of the cleat member to the edge on lateral side 18. In still other embodiments, any one or more of the shifted cleat members may be skewed towards midfoot region 12 in substantially similar degree independently of proximity to the lateral edge and/or medial edge. In other cases, shifted cleat members may have a skewed longitudinal axis. In different embodiments, the shifted cleat members may be skewed towards different regions of sole structure 104, including forefoot region 10, midfoot region 12, and/or heel region 14.

In some embodiments, one or more cleat members associated with the first cleat member set may have varying heights at portions of heel cleat system 114. In one embodiment, one or more of the shifted cleat members may be configured to have a shorter height adjacent to the medial edge. In an exemplary embodiment, fourth longitudinal hexagon cleat 406 may be associated with fourth height H4 as discussed above. As shown in FIG. 12, second shifted heel cleat member 1012 and third shifted heel cleat member 1014 located adjacent the medial edge may be generally associated with a shorter height than fourth longitudinal hexagon cleat 406.

In some embodiments, cleat members associated with the first cleat member set associated with heel cleat system 114 may include additional elements for providing traction. In an exemplary embodiment, the first cleat member set associated with heel cleat system 114 may include one or more second hexagonal cleat members 302 with gripping member 500 disposed on a ground-engaging end of the cleat member, as previously discussed.

Figure 13:
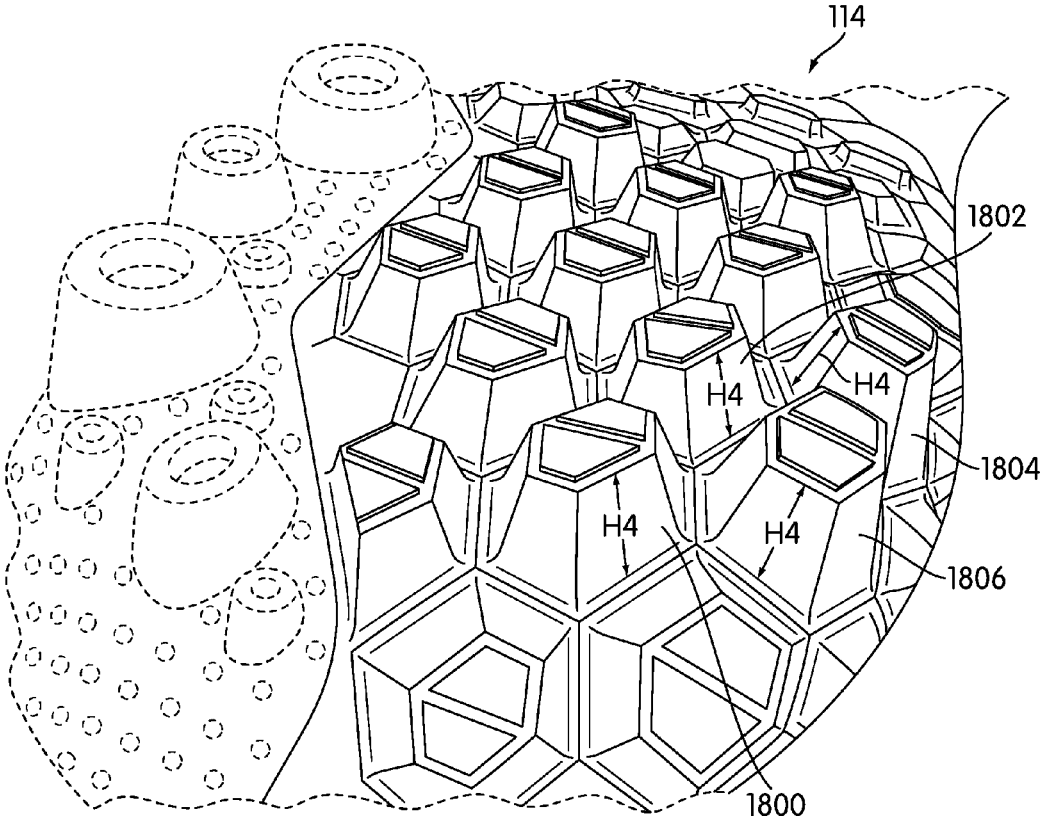
FIG. 13 is an enlarged isometric view of an alternate embodiment of a cleat system with a hexagonal cleat design.

FIG. 13 illustrates an alternate exemplary embodiment of cleat members associated with the first cleat member set of heal cleat system 114. In an exemplary embodiment, one or more of the shifted cleat members may be configured to have a substantially similar height across heel cleat system 114 to the medial edge. In this embodiment, heel cleat system 114 may include a first longitudinal hexagon cleat 1800 and a second longitudinal hexagon cleat 1802. Each of first longitudinal hexagon cleat 1800 and/or second longitudinal hexagon cleat 1802 may be associated with fourth height H4. In this embodiment, heel cleat system 114 may also include a first shifted heel cleat member 1804 and a second shifted heel cleat member 1806 located adjacent to the medial edge of the article. In an exemplary embodiment, first shifted heel cleat member 1804 and/or second shifted heel cleat member 1806 also may be associated with fourth height H4. With this arrangement, the cleat members disposed in heel cleat system 114 may be a substantially similar height for providing stability to a foot of a wearer of the article. In other embodiments, one or more of the shifted cleat members may be configured to have a longer height adjacent to the medial edge.

In some embodiments, one or more cleat members associated with the first cleat member set may have a different orientation of the vertical axis at portions of heal cleat system 114. In this embodiment, first shifted heel cleat member 1804 and second shifted heel cleat member 1806 may have a different orientation of the vertical axis than one or more cleat members disposed away from the medial edge, including first longitudinal hexagon cleat 1800 and/or second longitudinal hexagon cleat 1802. As shown FIG. 13, first longitudinal hexagon cleat 1800 and/or second longitudinal hexagon cleat 1802 may have a vertical axis that is oriented generally perpendicular to the plane of the article. On the other hand, first shifted heel cleat member 1804 and second shifted heel cleat member 1806 may have a vertical axis that is rotated towards the horizontal direction from the perpendicular. In other embodiments, one or more cleat members may have varying orientations along the vertical axis.

FIGS. 14 through 18 illustrate views of an exemplary embodiment of second cleat system 212. In one exemplary embodiment, second cleat system 212 may be made of second material 202 that is substantially more rigid than first material 200 that comprises first cleat system 210, as previously discussed. In some embodiments, medial forefoot cleat system 120, lateral forefoot cleat system 122, and lateral heel cleat system 124 may be associated with second cleat system 212. In an exemplary embodiment, medial forefoot cleat system 120 and/or lateral forefoot cleat system 122 may be disposed on an outer periphery of sole structure 104 in forefoot region 10 on, respectively, medial side 16 and lateral side 18. Similarly, lateral heel cleat system 124 may be disposed on an outer periphery of sole structure 104 in heel region 14 on lateral side 18. In different embodiments, second cleat system 212 may include one or more cleat systems disposed on various portions of sole structure 104, as previously discussed.

Figure 14:
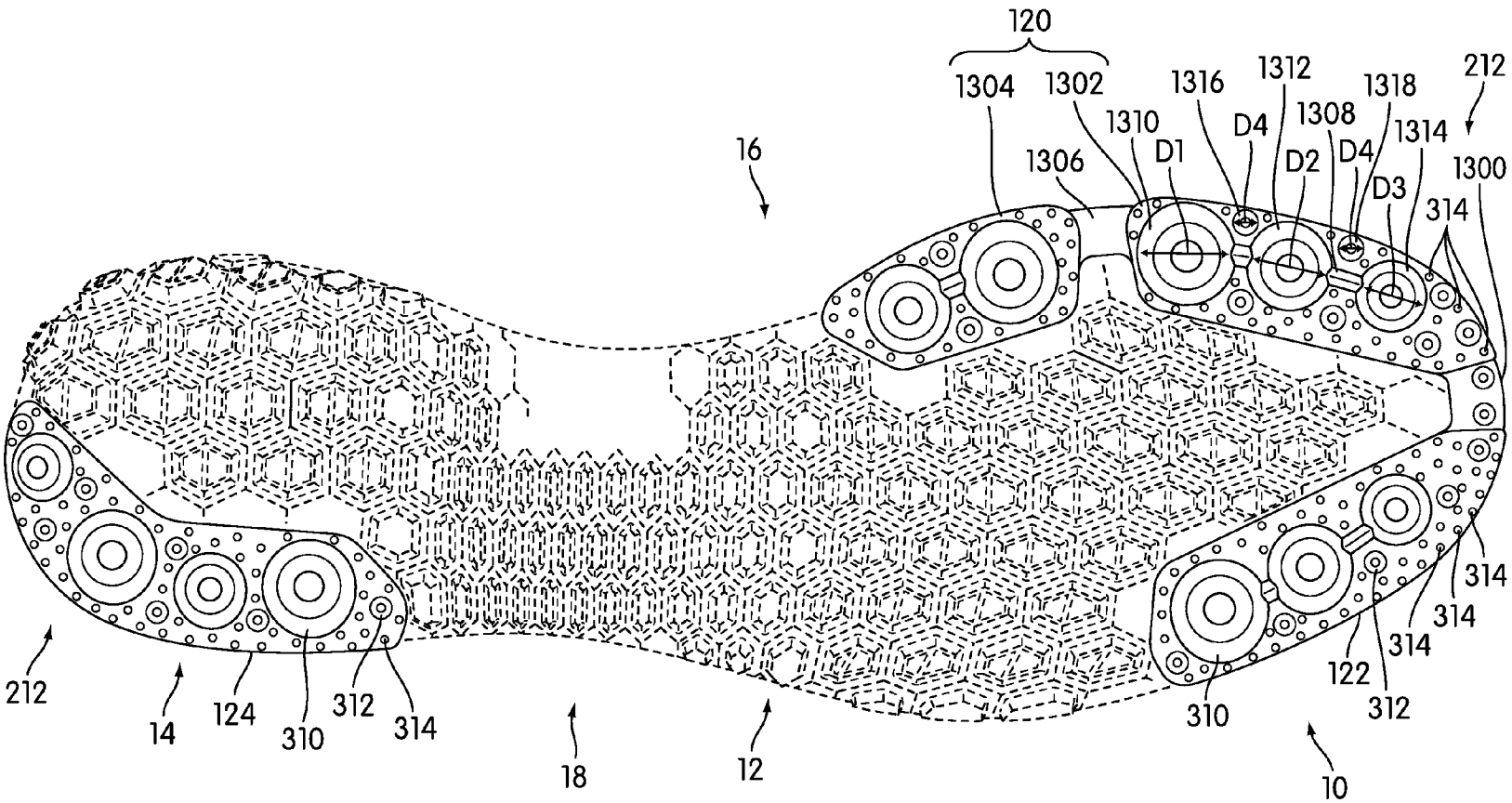
FIG. 14 is a plan view of an exemplary embodiment of a cleat system with a round cleat design.
Figure 15:
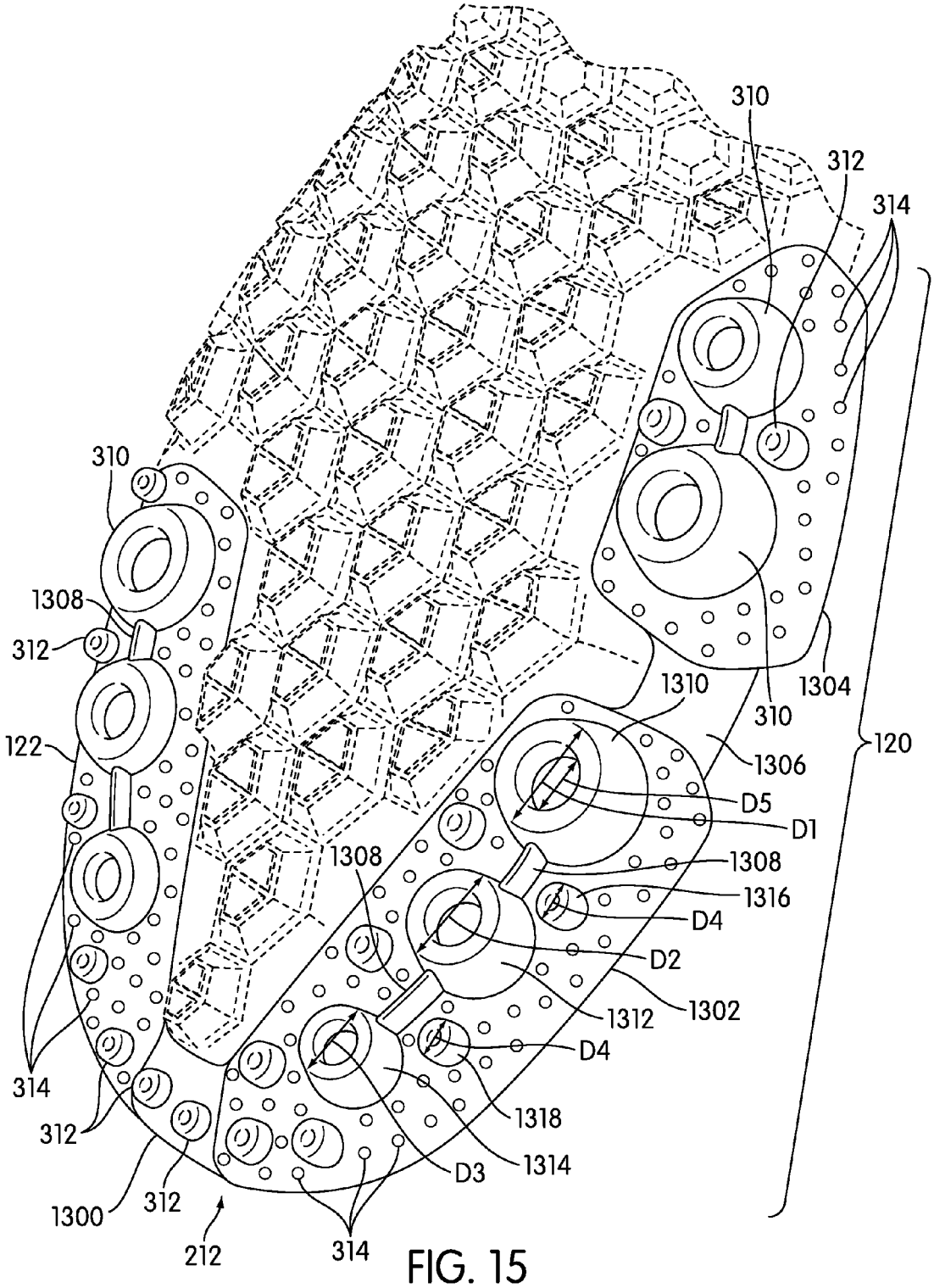
FIG. 15 is an enlarged isometric view of an exemplary embodiment of a forefoot region of a cleat system with a round cleat design.

Referring now to FIGS. 14 and 15, in some embodiments, cleat members of second cleat system 212 may be provided with a design of an approximately round cross-sectional shape. For example, in the current embodiment, medial forefoot cleat system 120, lateral forefoot cleat system 122, and/or lateral heel cleat system 124 associated with second cleat system 212 may include a plurality of cleat members with a conical shape 310, a plurality of cleat members with a cylindrical shape 312, and/or a plurality of cleat members with a round or domed shape 314. In other embodiments, round cleat members 314 may be comprised of a bump or other raised element comprised of any shape. In some cases, round cleat members 314 may further be associated with a raised portion connecting the plurality of round cleat members 314. In other cases, round cleat members 314 may be optional and the space between conical cleat members 310 and cylindrical cleat members 312 may be smooth.

In one exemplary embodiment, second cleat system 212 may include a toe portion 1300 located at the distal end of forefoot region 10. In this embodiment, toe portion 1300 may bridge the area between lateral forefoot cleat system 122 and medial forefoot cleat system 120. In some embodiments, toe portion 1300 may include one or more cylindrical cleat members 312. In some cases, toe portion 1300 may include one or more conical cleat members 310, cylindrical cleat members 312, and/or round cleat members 314. In other cases, toe portion 1300 may not contain any cleat members. In other embodiments, the area between lateral forefoot cleat system 122 and medial forefoot cleat system 120 may include a portion of first cleat system 210. In still other embodiments, lateral forefoot cleat system 122 and medial forefoot cleat system 120 may be comprised of a single cleat system.

In some embodiments, medial forefoot cleat system 120 may include a first cleat arrangement 1302 and a second cleat arrangement 1304. In this embodiment, each of first cleat arrangement 1302 and/or second cleat arrangement 1304 may include one or more conical cleat members 310, cylindrical cleat members 312, and/or round cleat members 314. In some embodiments, first cleat arrangement 1302 and second cleat arrangement 1304 may be connected by a medial bridge 1306. In some cases, medial bridge 1306 may be of a substantially smaller thickness than first cleat arrangement 1302 and/or second cleat arrangement 1304 to provide for flexibility between the arrangements. Flexibility in sole structure 104 at medial bridge 1306 may enhance bending movements of a foot of the wearer of article 100. In some cases, medial bridge 1306 may be comprised of a substantially similar rigid material as second cleat system 212. In other cases, medial bridge 1306 may be comprised of a semi-rigid material that has less rigidity than second material 202. In still other cases, medial bridge 1306 may be part of first cleat system 210 and may be comprised of a substantially similar material as first material 200.

In some embodiments, first cleat arrangement 1302 includes a plurality of conical cleat members 310 in varying sizes. Conical cleat members 310 may have a truncated conical body portion and an indented tip portion. In this exemplary embodiment, conical cleat members 310 may be represented by a first conical cleat 1310, a second conical cleat 1312, and a third conical cleat 1314. In this embodiment, first conical cleat 1310 may be associated with a first diameter D1, second conical cleat 1312 may be associated with a second diameter D2, and third conical cleat 1314 may be associated with a third diameter D3. In different embodiments, each individual cleat member of a design associated with conical cleat members 310 may have a diameter that is substantially similar to first diameter D1, second diameter D2, and/or third diameter D3 associated with first conical cleat 1310, second conical cleat 1312, and third conical cleat 1314, respectively. In different embodiments, conical cleat members 310 may have varying diameters.

In some embodiments, first cleat arrangement 1302 may include a plurality of cylindrical cleat members 312. Cylindrical cleat members 312 may have a cylindrical body portion a slightly indented tip portion. In this exemplary embodiment, cylindrical cleat members 312 may be represented by a first cylindrical cleat 1316 and a second cylindrical cleat 1318. In this embodiment, first cylindrical cleat 1316 and second cylindrical cleat 1318 may be associated with a fourth diameter D4. In different embodiments, each individual cleat member of a design associated with cylindrical cleat members 312 may have a diameter that is substantially similar to fourth diameter D4. In other embodiments, first cylindrical cleat 1316 and second cylindrical cleat 1318 may be associated with different diameters. In different embodiments, cylindrical cleat members 312 may have varying diameters. Additionally, first cleat arrangement 1302 also may include a plurality of round cleat members 314.

In some embodiments, a cleat bridge 1308 may extend between one or more first cylindrical cleat members 310. In this embodiment, cleat bridge 1308 may extend between first cylindrical cleat 1310 and second cylindrical cleat 1312. In other cases, cleat bridge 1308 additionally may extend between second cylindrical cleat 1312 and third cylindrical cleat 1314. In different embodiments, cleat bridge 1308 may extend between one or more first cylindrical cleat members 310 associated with second cleat system 212. In an exemplary embodiment, cleat bridge 1308 may be comprised of a semi-rigid material that is substantially less rigid than second material 202. With this arrangement, cleat bridge 1308 may provide additional stability and/or traction to a foot of the wearer of article 100.

Referring to FIG. 15, in different embodiments, the approximate diameters of the individual cleat members associated with each of conical cleat members 310, cylindrical cleat members 312, and/or round cleat members 314 may vary. In this embodiment, first conical cleat 1310 may be associated with first diameter D1, second conical cleat 1312 may be associated with second diameter D2, and third conical cleat 1314 may be associated with third diameter D3. Similarly, first cylindrical cleat 1316 and second cylindrical cleat 1318 may be associated with a fourth diameter D4. In this embodiment, first diameter D1 is larger than second diameter D2 and third diameter D3. Also, second diameter D2 is larger than third diameter D3. First diameter D1, second diameter D2, and/or third diameter D3 each are substantially larger than fourth diameter D4. In other words, first diameter D1, second diameter D2, third diameter D3, and fourth diameter D4 may have decreasing values in that same order.

In different embodiments, the values of first diameter D1, second diameter D2, third diameter D3, and fourth diameter D4 may vary. In some embodiments, first diameter D1 may have a value approximately in the range between 5 mm and 12 mm. Also, second diameter D2 may have a value approximately in the range between 4 mm and 10 mm. In addition, third diameter D3 may have a value approximately in the range between 3 mm and 8 mm. Fourth diameter may have a value approximately in the range between 2 mm and 5 mm. In an exemplary embodiment, first diameter D1, second diameter D2, third diameter D3, and fourth diameter D4 may have approximate values of 10 mm, 8 mm, 6 mm, and 3 mm, respectively. In other embodiments, however, first diameter D1, second diameter D2, third diameter D3, and fourth diameter D4 may have any other values.

By using cleat members of increasing diameter, the contact area between each cleat member and a ground surface may vary so that each cleat may be tuned to provide maximum traction for a different type of surface. In the current embodiment, cylindrical cleat members 312 may have a relatively small diameter that is optimized for maximizing traction with soft natural grass. In addition, conical cleat members 310 may have a relatively large diameter that is optimized for maximizing traction with a synthetic surface. Furthermore, some conical cleat members 310 also may have an intermediate sized diameter that is optimized for maximizing traction with firm natural grass.

Additionally, in some embodiments, conical cleat members 310 and cylindrical cleat members 312 may be provided with different heights. By using cleat members with different heights, the depth of penetration of each cleat member into a ground surface may vary so that each cleat can be tuned to provide maximum traction for a different type of surface. In the current embodiment, cylindrical cleat members 312 may have a relatively small height that is optimized for maximizing traction with soft natural grass. In addition, conical cleat members 310 may have a relatively large height that is optimized for maximizing traction with a synthetic surface. Furthermore, some conical cleat members 310 may have an intermediate sized height that is optimized for maximizing traction with natural grass.

In some embodiments, an interior portion of conical cleat members 310 may form the indented tip portion. In one exemplary embodiment, the indented tip portion may be associated with a fifth diameter D5. In this embodiment, fifth diameter D5 is smaller than first diameter D1. In various embodiments, the value of fifth diameter D5 forms the diameter of indented tip portion of conical cleat member 310. In different embodiments, fifth diameter D5 may vary in proportion to the value of the diameter associated with the respective conical cleat member 310. In some embodiments, first diameter D1 may have a value approximately in the range between 2 mm and 8 mm. In an exemplary embodiment, first diameter D1 and fifth diameter D5 may have approximate values of 10 mm and 6 mm, respectively. In other embodiments, however, first diameter D1 and fifth diameter D5 may have any other values.

Figure 16:
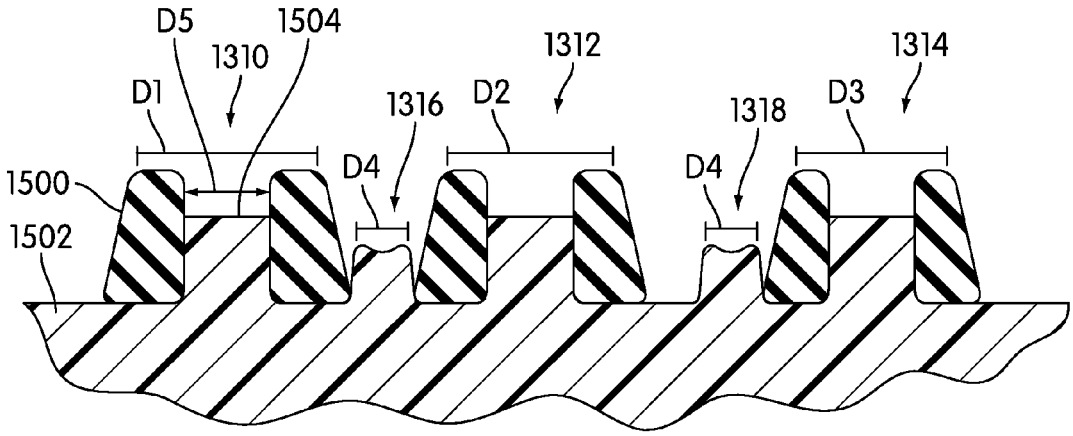
FIG. 16 is a cross sectional view of an exemplary embodiment of a cleat system with a round cleat design.

Referring now to FIG. 16, an exemplary embodiment of a cross-sectional view of second cleat system 212 is illustrated. In this embodiment, the indented tip portion of first conical cleat 1310 associated with first diameter D1 may have a center post 1504 associated with fifth diameter D5. In some embodiments, first conical cleat 1310 may be a composite cleat. In this embodiment, first conical cleat 1310 is a composite of two materials with different rigidities. As shown in FIG. 16, the composite cleat includes center post 1504 and a surrounding material 1500 that forms the outer portion of first conical cleat 1310. Center post 1504 may be comprised of a base material 1502. In some embodiments, base material 1502 may be a rigid material substantially similar to second material 202, and surrounding material 1500 may be a less rigid material substantially similar to first material 200. In this embodiment, base material 1502 that forms center post 1504 also may form one or more cylindrical cleat members 312, including first cylindrical cleat 1316 and/or second cylindrical cleat 1318. In some embodiments, base material 1502 may be integrally formed with one or more cylindrical cleat members 312 and/or round cleat members 314 (not shown). In some embodiments, surrounding material 1500 may be formed over base material 1502.

Figure 17:
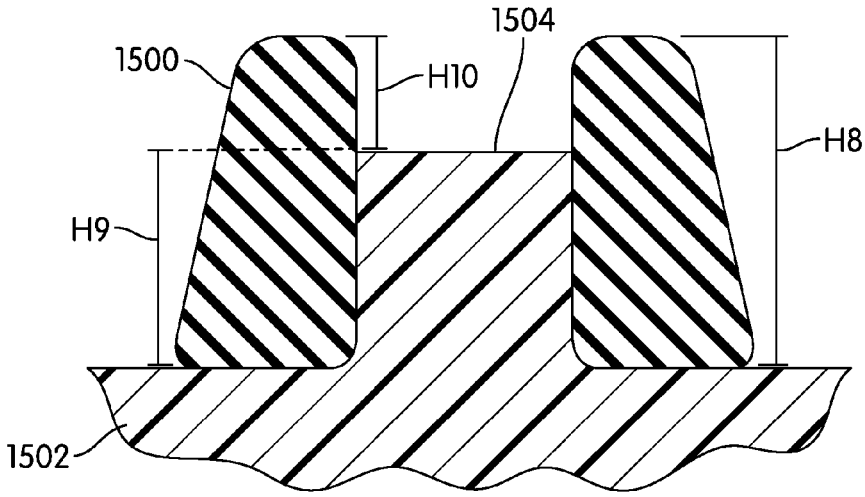
FIG. 17 is an enlarged cross sectional view of an exemplary embodiment of a round cleat member.

FIG. 17 illustrates an enlarged view of a composite cleat arrangement forming first conical cleat 1310. In this embodiment, first conical cleat 1310 may be associated with an eight height H8. Similarly, center post 1504 may be associated with a ninth height H9. In this exemplary embodiment, surrounding material 1500 may be associated with a tenth height H10 above center post 1504. With this arrangement, the indented tip portion of first conical cleat 1310 may have a depth that is substantially similar to the value of tenth height H10.

In different embodiments, the values of eight height H8, ninth height H9, and tenth height H10 may vary. In some embodiments, eighth height H8 may have a value approximately in the range between 6 mm and 14 mm. Also, ninth height H9 may have a value approximately in the range between 5 mm and 12 mm. In addition, tenth height H10 may have a value approximately in the range between 1 mm and 8 mm. In an exemplary embodiment, eight height H8, ninth height H9, and tenth height H10 may have approximate values of 12 mm, 8 mm, and 4 mm, respectively. In other embodiments, however, eight height H8, ninth height H9, and tenth height H10 may have any other values.

With this configuration, each element that comprises the composite cleat may undergo an amount of deformation upon contact with a ground surface that is optimized for a particular type of ground surface. For example, center post 1504 may be comprised of base material 1502 that does not deform much in order to maximize on a soft surface such as soft natural grass. In contrast, the outer portion of first conical cleat 1310 may be comprised of surrounding material 1500 that undergoes a higher amount of deformation to maximize traction on artificial turf surfaces, which are difficult to penetrate using cleat members and where it may be undesirable to use rigid cleats that puncture the turf. In other embodiments, base material 1502 and/or surrounding material 1500 may comprise a material that undergoes an intermediate amount of deformation to maximize traction on surfaces such as hard grass, where more deformation for a cleat member is desirable than on a surface such as soft natural grass.

Figure 18:
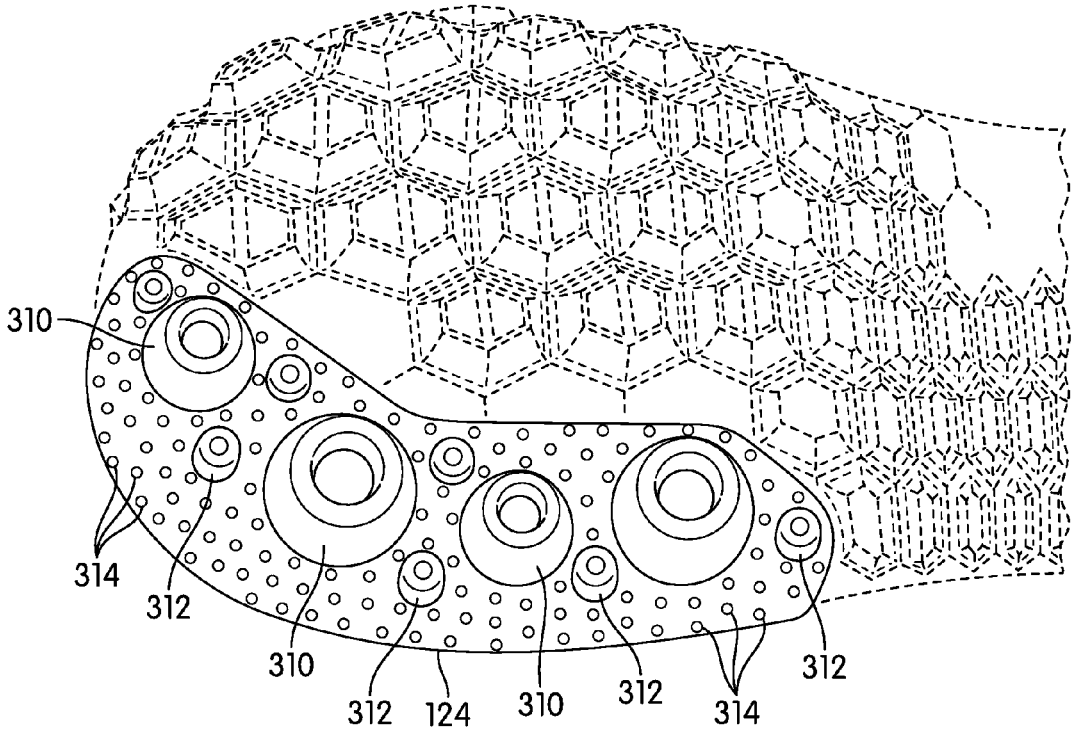
FIG. 18 is an enlarged top view of an exemplary embodiment of a heel region of a cleat system with a round cleat design.

Referring now to FIG. 18, lateral heel cleat system 124 associated with second cleat system 212 may include a plurality of cleat members with a conical shape 310, a plurality of cleat members with a cylindrical shape 312, and/or a plurality of cleat members with a round or domed shape 314. In other embodiments, round cleat members 314 may be comprised of a bump or other raised element comprised of any shape. In some cases, round cleat members 314 may further be associated with a raised portion connecting the plurality of round cleat members 314. In other cases, round cleat members 314 may be optional and the space between conical cleat members 310 and cylindrical cleat members 312 may be smooth. In different embodiments, conical cleat members 310 of varying diameters, as previously discussed, may be provided on lateral heel cleat system 124. In one exemplary embodiment, lateral heel cleat system 124 may include conical cleat members 310 that alternate between a larger diameter and a smaller diameter in a direction from midfoot region 12 towards the distal end of heel region 14. In other embodiments, conical cleat members 310 may be substantially similar in size and/or arrangement. Similarly, lateral heel cleat system 124 may include cylindrical cleat members 312 that have various arrangements as previously discussed.

In one exemplary embodiment, lateral heel cleat system 124 may be disposed on an outer periphery of sole structure 104 in heel region 14 on lateral side 18. In other embodiments, sole structure 104 additionally may include a medial heel cleat system disposed on an outer periphery of sole structure 104 in heel region 14 on medial side 16. In some cases, matching articles of footwear may have heel cleat systems disposed on opposing sides. For example, an article for a left foot may have lateral heel cleat system 124 disposed on lateral side 18, while a matching article for a right foot may have a medial heel cleat system disposed on medial side 16. In other cases, sole structure 104 may not include lateral heel cleat system 124 and/or a medial heel cleat system. In various embodiments, individual and/or pairs of articles may have other arrangements of heel cleat systems, as previously discussed.

It will be understood that the combination of characteristics taught in the exemplary embodiments may provide cleat systems that are optimized for use on different ground surfaces. Specifically, second cleat system 212 may be provided with a material of a generally high rigidity that undergoes little deformation upon contact with a ground surface. Furthermore, first cleat system 210 may comprise a large number of cleat members that are generally evenly distributed through a central portion of sole structure 104. With this arrangement, first cleat system 210 and/or second cleat system 212 may help to maximize traction on natural grasses, as well as on artificial turf and other synthetic surfaces.

This arrangement helps to provide maximum traction over multiple surfaces without the need for a user to change footwear. In other words, a single pair of footwear can be used with synthetic turf, natural grass and soft natural grass. This may help save a user the costs associated with purchasing multiple different pairs of footwear for use on different types of surfaces.

It will be understood that while the current embodiments use two cleat systems that are optimized for artificial turf, firm natural grasses and/or soft natural grasses, in other embodiments these cleat systems could be tuned to provide maximum traction on any other types of surfaces. In other embodiments, the rigidity, height, diameter, shape, location and number of cleat members comprising each cleat system may be tuned to maximize traction on any types of ground surfaces. Moreover, in still other embodiments, additional cleat systems may be provided to obtain maximum traction on additional types of ground surfaces. For example, in another embodiment, three distinct cleat systems may be used for maximizing traction on three different types of ground surfaces.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

a sole structure, the sole structure including a first cleat system comprised of a first material and a second cleat system comprised of a second material;

the first cleat system having a first cleat design, wherein the first cleat design comprises a first plurality of cleat members with a generally hexagonal shape;

the second cleat system having a second cleat design, wherein the second cleat design comprises a second plurality of cleat members with a generally round cross-sectional shape;

the first cleat system being associated with a forefoot region, a midfoot region, and a heel region of the sole structure;

the second cleat system being associated with a first portion of the forefoot region and a second portion of the heel region;

wherein the second material is substantially more rigid than the first material; and wherein the second plurality of cleat members further comprises:

at least one composite cleat made of a base material and a surrounding material; and wherein the base material is made of the second material and the surrounding material is made of the first material.

2. The article of footwear according to claim 1, wherein the first material includes at least one of rubber or hard foam.

3. The article of footwear according to claim 2, wherein the second material includes at least one of plastic, polymer, nylon, or polyurethane.

4. The article of footwear according to claim 1, wherein the base material further comprises a center post extending a first height above the sole structure;

the surrounding material extending a second height above the sole structure; and wherein the second height is greater than the first height.

5. The article of footwear according claim 1, wherein the first portion comprises an outer periphery of the sole structure in the forefoot region.

6. The article of footwear according to claim 1, wherein the second portion comprises an outer periphery of the sole structure in the heel region.

7. The article of footwear according to claim 6, wherein the second portion consists essentially of the outer periphery on the lateral side of the heel region.

8. An article of footwear, comprising:

a sole structure, the sole structure including a first cleat member set and a second cleat member set;

the first cleat member set having a plurality of first cleat members with a length substantially oriented along the longitudinal axis of the article of footwear;

the second cleat member set having a plurality of second cleat members with a length substantially oriented along the lateral axis of the article of footwear;

wherein the first cleat member set is generally associated with a forefoot region and/or a heel region of the sole structure; and wherein the second cleat member set is generally associated with a midfoot region of the sole structure.

9. The article of footwear according to claim 8, wherein the plurality of first cleat members further comprises:

a distal set of first cleat members that is located near the distal end of the forefoot region and/or heel region;

a proximal set of first cleat members that is located near the midfoot region; and wherein the distal set of first cleat members are longer than the proximal set of first cleat members.

10. The article of footwear according to claim 8, wherein the length of the first cleat members diminishes in correspondence with the proximity of the first cleat members to the midfoot region.

11. The article of footwear according to claim 8, wherein the second cleat members have a width substantially oriented along the longitudinal axis of the article of footwear; and wherein the length of the first cleat members is greater than the width of the second cleat members.

12. The article of footwear according to claim 8, wherein at least one of the first cleat members further comprises a gripping member disposed on a ground-engaging end of the at least one first cleat member.

13. The article of footwear according to claim 8, wherein the plurality of first cleat members further comprises:

shifted cleat members having a lateral axis that is skewed towards the midfoot region of the sole structure; and wherein the shifted cleat members are associated with a lateral edge of the forefoot region and/or a medial edge of the heel region.

14. The article of footwear according to claim 13, wherein the lateral axis of the shifted cleat members is skewed towards the midfoot region in greater degree in correspondence with the proximity of the shifted cleat members to the lateral edge of the forefoot region and/or the medial edge of the heel region.

15. An article of footwear, comprising:

a sole structure, the sole structure including a first cleat member set and a second cleat member set;

wherein the first cleat member set is generally associated with a forefoot region and/or a heel region of the sole structure;

wherein the second cleat member set is generally associated with a midfoot region of the sole structure;

the first cleat member set having a plurality of first cleat members with a length substantially oriented along the longitudinal axis of the article of footwear that extend a first height above the sole structure;

the second cleat member set having a plurality of second cleat members with a length substantially oriented along the lateral axis of the article of footwear that extend a second height above the sole structure; and wherein the first height is greater than the second height.

16. The article of footwear according to claim 15, wherein the first height of the first cleat members diminishes to substantially the second height in correspondence with the proximity of the first cleat members to the midfoot region.

17. The article of footwear according to claim 15, wherein the plurality of first cleat members further comprises:

a distal set of first cleat members that is located near the distal end of the forefoot region and/or heel region;

a proximal set of first cleat members that is located near the midfoot region; and wherein the distal set of first cleat members extend a greater height above the sole structure than the proximal set of first cleat members.

18. The article of footwear according to claim 15, wherein the second cleat members have a width substantially oriented along the longitudinal axis of the article of footwear; and wherein the length of the first cleat members is greater than the width of the second cleat members.

19. The article of footwear according to claim 15, further comprising:

a first cleat system having a first cleat design comprised of a first material, wherein the first cleat member set and the second cleat member set are associated with the first cleat system;

a second cleat system having a second cleat design comprised of a second material;

the first cleat system being associated with a forefoot region, a midfoot region, and a heel region of the sole structure;

the second cleat system being associated with a first portion of the forefoot region and a second portion of the heel region; and wherein the second material is substantially more rigid than the first material.

20. The article of footwear according to claim 19, wherein the first cleat design comprises a first plurality of cleat members with a generally hexagonal shape; and wherein the second cleat design comprises a second plurality of cleat members with a generally round cross-sectional shape.

* * * * *